US006416941B1

(12) United States Patent
Reed et al.

(10) Patent No.: US 6,416,941 B1
(45) Date of Patent: Jul. 9, 2002

(54) COLOR PHOTOGRAPHIC ELEMENTS OF INCREASED SENSITIVITY

(75) Inventors: Kenneth J. Reed; Annabel A. Muenter, both of Rochester; Sharon R. Lunt, Webster; David T. Southby, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/468,386

(22) Filed: Dec. 20, 1999

Related U.S. Application Data

(63) Continuation-in-part of application No. 09/213,639, filed on Dec. 17, 1998.

(51) Int. Cl.[7] ..... G03C 1/08

(52) U.S. Cl. ..... 430/546; 430/551; 430/557; 430/558; 430/599; 430/600; 430/583

(58) Field of Search ..... 430/551, 546, 430/557, 558, 599, 600, 583

(56) References Cited

U.S. PATENT DOCUMENTS

| | | | | | |
|---|---|---|---|---|---|
| 4,439,520 | A | | 3/1984 | Kofron et al. | |
| 4,859,578 | A | * | 8/1989 | Michno et al. | 430/544 |
| 4,912,025 | A | * | 3/1990 | Platt et al. | 430/544 |
| 5,604,085 | A | | 2/1997 | Maskasky | |
| 5,605,786 | A | * | 2/1997 | Saito et al. | 430/533 |
| 5,620,840 | A | | 4/1997 | Maskasky | |
| 5,667,955 | A | | 9/1997 | Maskasky | |
| 5,691,131 | A | | 11/1997 | Maskasky | |
| 5,733,718 | A | | 3/1998 | Maskasky | |
| 5,747,235 | A | * | 5/1998 | Farid et al. | 430/583 |
| 5,747,236 | A | | 5/1998 | Farid et al. | |
| 5,792,602 | A | | 8/1998 | Maskasky et al. | |
| 5,965,322 | A | * | 10/1999 | Makuta et al. | 430/264 |
| 5,994,047 | A | * | 11/1999 | Mizukawa et al. | 430/548 |
| 6,010,841 | A | * | 1/2000 | Farid et al. | 430/583 |
| 6,027,869 | A | * | 2/2000 | Maskasky et al. | 430/567 |

FOREIGN PATENT DOCUMENTS

| | | | |
|---|---|---|---|
| EP | 679 943 | * | 4/1994 |

OTHER PUBLICATIONS

Research Disclosure 36544, pp. 501, 504, and 533, Sep. 1994.*

Research Disclosure, vol. 389, Sep. 1996, Item 38957, I., II., IV., V., and X.

* cited by examiner

*Primary Examiner*—Janet Baxter
*Assistant Examiner*—Amanda C. Walke
(74) *Attorney, Agent, or Firm*—Edith A. Rice

(57) ABSTRACT

A color photographic element comprises a support and at least one dye image forming layer unit comprising gelatin-peptized radiation-sensitive silver halide grains, a fragmentable electron donating compound; and an electron transfer agent releasing compound.

30 Claims, No Drawings

COLOR PHOTOGRAPHIC ELEMENTS OF INCREASED SENSITIVITY

CROSS-REFERENCE TO RELATED APPLICATIONS

This is a continuation-in-part of application Ser. No. 09/213,639, filed Dec. 17, 1998, entitled "COLOR PHOTGRAPHIC ELEMENTS OF INCREASED SENSITIVITY", by Maskasky et al.

FIELD OF THE INVENTION

The invention relates to color photography. More specifically, the invention relates to color photographic elements that contain layer units that contain radiation-sensitive silver halide emulsions and produce dye images.

BACKGROUND OF THE INVENTION

The characteristic that is primarily responsible for the dominance of silver halide photography is the image amplification capability of silver halide grains. During imagewise exposure of a silver halide photographic element, incident photons are absorbed by the silver halide grains. When a photon is absorbed, an electron in the silver halide crystal lattice structure of a grain is promoted from a valence band energy level to a higher, conduction band energy level at which it is capable of migrating within the crystal lattice of the grain. When a few conduction band electrons are captured by crystal lattice silver ions in close proximity, a cluster of $Ag^{\circ}$ atoms is created, commonly referred to as a latent image site. The latent image site of a grain is capable of catalyzing the overall reduction of silver ions in the grain to $Ag^{\circ}$, a huge amplification of the few original $Ag^{+}$ reductions to $Ag^{\circ}$ created by imagewise exposure. An imagewise exposed silver halide emulsion is brought into contact with a developer to produce a viewable image. A developer is an aqueous solution containing a developing agent, a reducing agent capable of selectively reducing latent image bearing silver halide grains to $Ag^{\circ}$. Contacting a photographic element with aqueous solutions, including a developer, to produce a viewable image is referred to as photographic processing.

Although many factors come into play in obtaining desirable photographic images, one of the most fundamental is the speed of the photographic element employed. While silver halide photography with its internal amplification mechanism exhibits much higher photographic speeds than other imaging systems, the search for higher photographic speeds in silver halide photography has continued since its inception to the present time, a time period of well over a century. The speed of a photographic element is measured by exposing sample portions of the element at differing levels and then correlating image density following photographic processing. By plotting image density (D) as an ordinate against the log of exposure (E) in lux-seconds, a characteristic curve is generated. The characteristic curve typically contains a portion that exhibits no change in density (minimum density or $D_{min}$) as a function of exposure transitioning with increased exposures to a portion in which density increases as a function of increased exposure, often resulting in a linear characteristic curve segment (i.e., $\Delta D/\Delta \log E$ remains constant) transitioning with still higher exposures to a portion in which further exposure does not increase density (maximum density or $D_{max}$) Photographic element speeds are usually reported as differences in log E required to produce the same density in compared elements.

Silver halide emulsions possess a native sensitivity to light having wavelengths ranging from the ultraviolet into the blue region of the visible spectrum. Spectral sensitizing dyes are adsorbed to the silver halide grain surfaces to extend sensitivity to longer wavelength portions of the spectrum. A summary of spectral sensitizing dyes is provided by *Research Disclosure*, Item 38957, cited above, V. Spectral sensitization and desensitization, A. Sensitizing Dyes. The function of a spectral sensitizer is to capture for latent image formation a photon of a wavelength the silver halide grain cannot itself capture.

To increase the speed of silver halide emulsions independent of spectral sensitization, the grain surfaces are treated with chemical sensitizers. A summary of chemical sensitizers is provided by *Research Disclosure*, Item 38957, cited above, IV. Chemical sensitization.

It has been recently recognized that a further enhancement in photographic speed can be realized by associating with the silver halide grain surfaces a fragmentable electron donating (FED) sensitizer. While no proof of the mechanism of FED sensitization has yet been generated, one plausible explanation is as follows: When, as noted above, photon capture within a grain results in electron promotion from a valence shell to a conduction energy band, a common loss factor is recombination. That is, the promoted electron simply returns to a hole in the valence shell, created by promotion to the conduction band of the same or another electron. When recombination occurs, the energy of the captured photon is dissipated without contributing to latent image formation. It is believed that the FED sensitizer reduces recombination by donating an electron to fill the hole created by photon capture. Thus, fewer conduction band electrons return to hole sites in valence bands and more electrons are available to participate in latent image formation.

When the FED sensitizer donates an electron to a silver halide grain, it fragments, creating a cation and a free radical. The free radical is a single atom or compound that contains an unpaired valence shell electron and is for that reason highly unstable. If the oxidation potential of the free radical is equal to or more negative than −0.7 volt, the free radical immediately upon formation injects a second electron into the grain to eliminate its unpaired valence shell electron. When the free radical also donates an electron to the grain, it is apparent that absorption of a single photon in the grain has promoted an electron to the conduction band, stimulated the FED sensitizer to donate an electron to file the hole left behind by the promoted electron, thereby reducing hole-electron recombination, and injected a second electron. Thus, the FED sensitizer contributes one or two electrons to the silver grain that contribute directly or indirectly to latent image formation.

FED sensitizers and their utilization for increasing photographic speed are disclosed in Farid et al U.S. Pat. Nos. 5,747,235 and 5,7547,236, and in the following commonly assigned filings: Lenhard et al U.S. Ser. No. 08/739,911, filed Oct. 30, 1996, and Gould et al U.S. Ser. No. 09/118,536, Farid et al U.S. Ser. No. 09/118,552, and Adin et al U.S. Ser. No. 09/118,714, each filed Jun. 25, 1998. The entire disclosures of these applications are incorporated herein by reference.

When silver halide is reduced to silver during development, the neutral density of the developed silver can be relied upon to create a black-and-white photographic image. Another imaging approach is to employ a primary amine color developing agent during development. The oxidized color developing agent is then reacted (coupled) with a dye image providing coupler to form an image dye.

So-called "chromogenic" black-and-white images can be formed in which a combination of image dye forming couplers are employed to produce a black dye image which can be used in place of or in combination with developed silver to produce a black-and-white image. Where an image hue other than black (typically a subtractive primary hue) is sought, the neutral density of silver is removed by bleaching and fixing, and the dye formed by the reaction product of the image dye forming coupler and the color developing agent is relied upon exclusively for image dye formation. Dye imaging is extensively used, since a photographic element containing red, blue and green recording layer units capable of producing three spectrally distinguishable dye image records permits a photographic image to be obtained for viewing that acceptably replicates the natural hues of the subject photographed.

In the last two decades enhancements in dye images attributable to the incorporation of dye image modifying couplers have become common. These couplers, which often do not form an image dye on coupling, can be relied upon for immediate or timed release of photographically useful fragments, such as development accelerators, development inhibitors, bleach accelerators, bleach inhibitors, developing agents (e.g., competing or auxiliary developing agents), silver complexing agents, fixing agents, toners, hardeners, tanning agents, antistain agents, stabilizers, antifoggants, competing couplers, and chemical or spectral sensitizers or desensitizers.

A summary of couplers is provided by *Research Disclosure*, Item 38957, cited above, X. Dye image formers and modifiers, particularly B. Image-dye-forming couplers and C. Image dye modifiers.

Problem to be Solved by the Invention

While the fragmentable electron donating sensitizers have been shown to provide additional speed to emulsion grains, there is a continuing need for further enhancing the speed available from these compounds, in order to provide silver halide materials with the highest possible light sensitivity.

SUMMARY OF THE INVENTION

One aspect of this invention comprises a color photographic element comprising a support and at least one dye image forming layer unit comprising gelatin-peptized radiation-sensitive silver halide grains, a fragmentable electron donating compound; and an electron transfer agent releasing compound.

Advantageous Effect of the Invention

In comparing emulsions, in particular tabular emulsion grains, treated with a fragmentable electron donating (FED) sensitizer, the effect of this sensitizer is greater when the emulsion is coated with an electron transfer agent releasing compound. Similarly, the effect of the electron transfer agent releasing compound is enhanced when the emulsion is treated with a FED sensitizer. These beneficial synergies are unexpected.

DETAILED DESCRIPTION OF THE INVENTION

In accordance with this invention a silver halide emulsion, as described in more detail below, contains a fragmentable electron donating (FED) compound which enhances the sensitivity of the emulsion. The fragmentable electron donating compound is of the formula X—Y' or a compound which contains a moiety of the formula —X—Y';

wherein

X is an electron donor moiety, Y' is a leaving proton H or a leaving group Y, with the proviso that if Y' is a proton, a base, $\beta^-$, is covalently linked directly or indirectly to X, and wherein:

1) X—Y' has an oxidation potential between 0 and about 1.4 V; and 2) the oxidized form of X—Y' undergoes a bond cleavage reaction to give the radical $X^\bullet$ and the leaving fragment Y'; and, optionally, 3) the radical $X^\bullet$ has an oxidation potential $\leqq -0.7$V (that is, equal to or more negative than about −0.7V).

Compounds wherein X—Y' meets criteria (1) and (2) but not (3) are capable of donating one electron and are referred to herein as fragmentable one-electron donating compounds. Compounds which meet all three criteria are capable of donating two electrons and are referred to herein as fragmentable two-electron donating compounds.

In this patent application, oxidation potentials are reported as "V" which represents "volts versus a saturated calomel reference electrode".

In embodiments of the invention in which Y' is Y, the following represents the reactions that are believed to take place when X—Y undergoes oxidation and fragmentation to produce a radical $X^\bullet$, which in a preferred embodiment undergoes further oxidation.

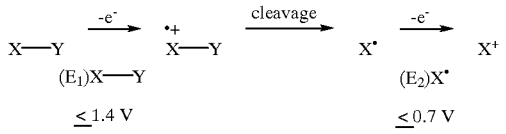

where $E_1$ is the oxidation potential of X—Y and $E_2$ is the oxidation potential of the radical $X^\bullet$.

$E_1$ is preferably no higher than about 1.4 V and preferably less than about 1.0 V. The oxidation potential is preferably greater than 0, more preferably greater than about 0.3 V. $E_1$ is preferably in the range of about 0 to about 1.4 V, and more preferably from about 0.3 V to about 1.0 V.

In certain embodiments of the invention the oxidation potential, $E_2$, of the radical $X^\bullet$ is equal to or more negative than −0.7V, preferably more negative than about −0.9 V. $E_2$ is preferably in the range of from about −0.7 to about −2 V, more preferably from about −0.8 to about −2 V and most preferably from about −0.9 to about −1.6 V.

The structural features of X—Y are defined by the characteristics of the two parts, namely the fragment X and the fragment Y. The structural features of the fragment X determine the oxidation potential of the X—Y molecule and that of the radical $X^\bullet$, whereas both the X and Y fragments affect the fragmentation rate of the oxidized molecule $X—Y^{108+}$.

In embodiments of the invention in which Y' is H, the following represents the reactions believed to take place when the compound X—H undergoes oxidation and deprotonation to the base, $\beta^-$, to produce a radical $X^{108}$, which in a preferred embodiment undergoes further oxidation.

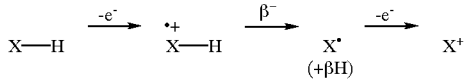

Preferred X groups are of the general formula:

(I)

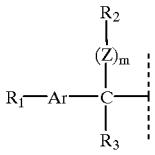

(II)

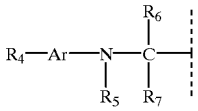

(III)

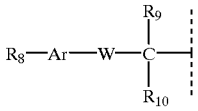

or (IV)

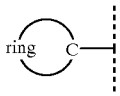

The symbol "R" (that is R without a subscript) is used in all structural formulae in this patent application to represent a hydrogen atom or an unsubstituted or substituted alkyl group In structure (I):

m=0, 1;

Z=O, S, Se, Te;

Ar=aryl group (e.g., phenyl, naphthyl, phenanthryl, anthryl); or heterocyclic group (e.g., pyridine, indole, benzimidazole, thiazole, benzothiazole, thiadiazole, etc.);

$R_1$=R, carboxyl, amide, sulfonamide, halogen, $NR_2$, $(OH)_n$, $(OR')_n$, or $(SR)_n$;

R'=alkyl or substituted alkyl;

n=1–3;

$R_2$=R, Ar';

$R_3$=R, Ar';

$R_2$ and $R_3$ together can form 5- to 8-membered ring;

$R_2$ and Ar=can be linked to form 5- to 8-membered ring;

$R_3$ and Ar=can be linked to form 5- to 8-membered ring;

Ar'=aryl group such as phenyl, substituted phenyl, or heterocyclic group (e.g., pyridine, benzothiazole, etc.)

R=a hydrogen atom or an unsubstituted or substituted alkyl group.

In structure (II):

Ar=aryl group (e.g., phenyl, naphthyl, phenanthryl); or heterocyclic group (e.g., pyridine, benzothiazoic, etc.);

$R_4$=a substituent having a Hammett sigma value of −1 to +1, preferably −0.7 to +0.7, e.g., R, OR, SR, halogen, CHO, C(O)R, COOR, $CONR_2$, $SO_3R$, $SO_2NR_2$, $SO_2R$, SOR, C(S)R, etc;

$R_5$=R, Ar'

$R_6$ and $R_7$=R, Ar'

$R_5$ and Ar=can be linked to form 5- to 8-membered ring;

$R_6$ and Ar=can be linked to form 5- to 8-membered ring (in which case, $R_6$ can be a hetero atom);

$R_5$ and $R_6$ can be linked to form 5- to 8-membered ring;

$R_6$ and $R_7$ can be linked to form 5- to 8-membered ring;

Ar'=aryl group such as phenyl, substituted phenyl, heterocyclic group;

R=hydrogen atom or an unsubstituted or substituted alkyl group.

A discussion on Hammett sigma values can be found in C. Hansch and R. W. Taft *Chem. Rev.* Vol 91, (1991) p 165, the disclosure of which is incorporated herein by reference.

In structure (III).

W=O, S, Se;

Ar=aryl group (e.g., phenyl, naphthyl, phenanthryl, anthryl); or heterocyclic group (e.g., indole, benzimidazole, etc.)

$R_8$=R, carboxyl, $NR_2$, $(OR)_n$, or $(SR)_n$, (n=1–3);

$R_9$ and $R_{10}$=R, Ar';

$R_9$ and Ar=can be linked to form 5- to 8-membered ring;

Ar'=aryl group such as phenyl substituted phenyl or heterocyclic group;

R=a hydrogen atom or an unsubstituted or substituted alkyl group.

In structure (IV):

"ring" represents a substituted or unsubstituted 5-, 6- or 7-membered unsaturated ring, preferably a heterocyclic ring.

The following are illustrative examples of the group X of the general structure I:

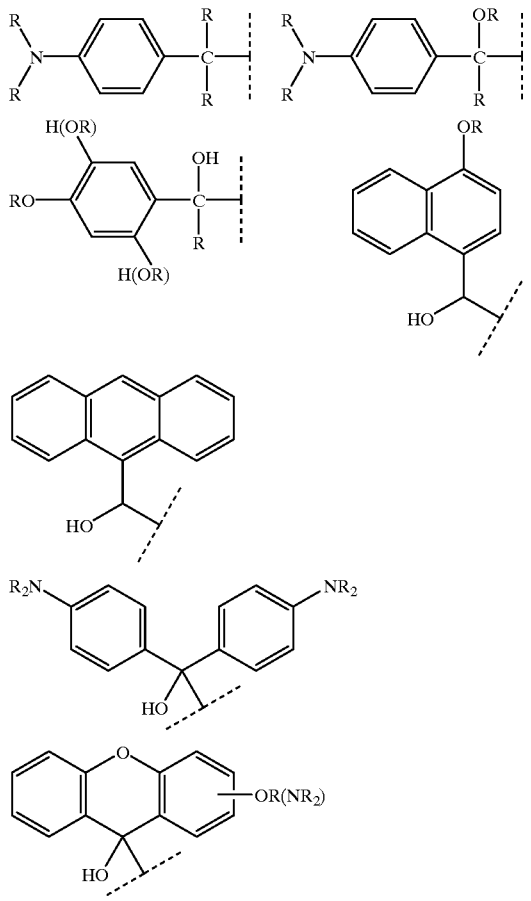

-continued

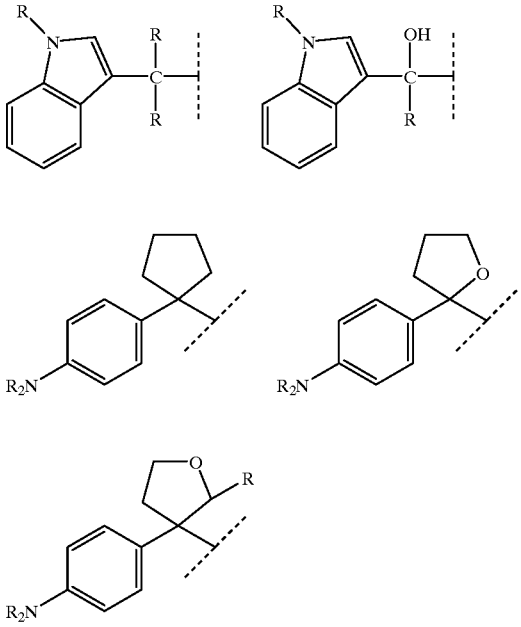

In the structures of this patent application a designation such as —OR($NR_2$) indicates that either —OR or —$NR_2$ can be present.

The following are illustrative examples of the group X of general structure II:

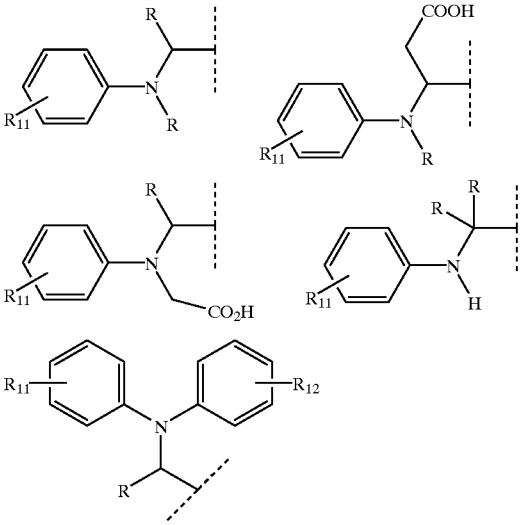

$R_{11}$ and $R_{12}$ =

| | |
|---|---|
| H | carboxyl |
| alkyl | amido |
| alkoxy | formyl |
| alkythio | sulfonyl |
| halo | sulfonamido |
| carbamoyl | nitrile |

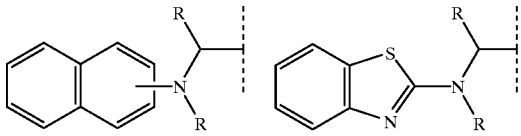

-continued

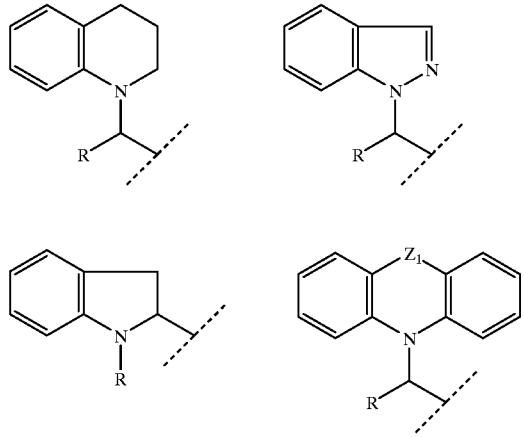

$Z_1$=a covalent bond, S, O, Se, NR, $CR_2$, CR=CR, or $CH_2CH_2$.

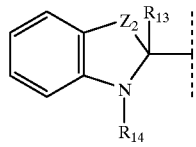

$Z_2$=S, O, Se, NR, $CR_2$, CR=CR, $R_{13}$, alkyl, substituted alkyl or aryl, and $R_{14}$=H, alkyl substituted alkyl or aryl.

The following are illustrative examples of the group X of the general structure III:

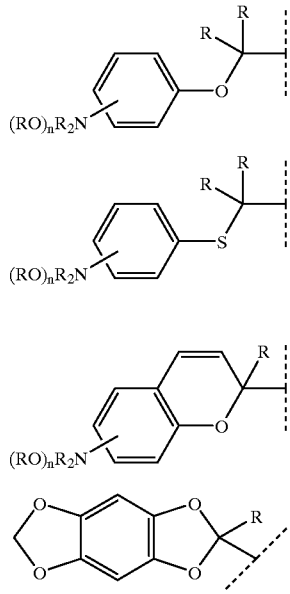

n=1–3

The following are illustrative examples of the group X of the general structure IV:

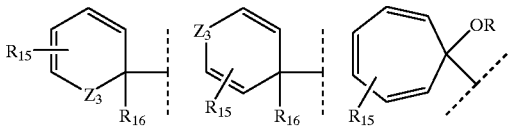

$Z_3$=O, S, Se, NR $R_{15}$=R, OR, $NR_2$ $R_{16}$=alkyl, substituted alkyl

Preferred Y' groups are:

(1) X', where X' is an X group as defined in structures I–IV and may be the same as or different from the X group to which it is attached (2) ⊢—$COO^-$ (3) ⊢—$M(R')_3$
where M=Si, Sn or Ge; and R'=alkyl or substituted alkyl (4) ⊢—$B^-(AR'')_3$
where Ar"=aryl or substituted aryl (5) ⊢—H In preferred embodiments of this invention Y' is —H, —$COO^-$ or —$Si(R')_3$ or —X'. Particularly preferred Y' groups are —H, —$COO^-$ or —$Si(R')_3$.

In embodiments of the invention in which Y' is a proton, a base, $\beta^-$,is covalently linked directly or indirectly to X. The base is preferably the conjugate base of an acid of pKa between about 1 and about 8, preferably about 2 to about 7. Collections of pKa values are available (see, for example: Dissociation Constants of Organic Bases in Aqueous Solution, D. D. Perrin (Butterworths, London, 1965); CRC Handbook of Chemistry and Physics, 77th ed, D. R. Lide (CRC Press, Boca Raton, Fla., 1996)). Examples of useful bases are included in Table A

TABLE A

| pKa's in water of the conjugate acids of some useful bases | |
|---|---|
| $CH_3$—$CO_2^-$ | 4.76 |
| $C_2H_5CO_2^-$ | 4.87 |
| $(CH_3)_2CH$—$CO_2^-$ | 4.84 |
| $(CH_3)_3C$—$CO_2^-$ | 5.03 |
| HO—$CH_2$—$CO_2^-$ | 3.83 |
| 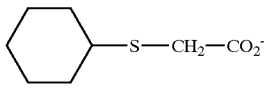 | 3.48 |
| $CH_3$—CO—NH—$CH_2$—$CO_2^-$ | 3.67 |
| 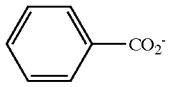 | 4.19 |
| 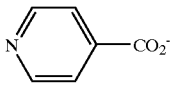 | 4.96 |
| $CH_3$—$COS^-$ | 3.33 |
| 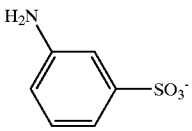 | 3.73 |

TABLE A-continued

| pKa's in water of the conjugate acids of some useful bases | |
|---|---|
| 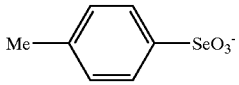 | 4.88 |
| 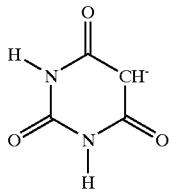 | 4.01 |
| 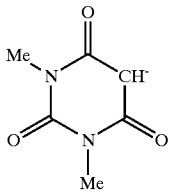 | 4.7 |
| $(CH_3)_3\overset{+}{N}$—$\overset{-}{O}$ | 4.65 |
| $H_2N$—$CH_2$—CH($CH_3$)—$\overset{+}{N}H_3$ | 6.61 |
| 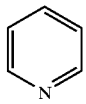 | 5.25 |
| 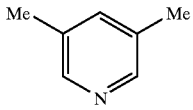 | 6.15 |
| 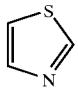 | 2.44 |
| 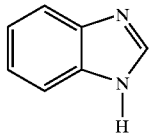 | 5.53 |

Preferably the base, $\beta^-$ is a carboxylate, sulfate or amine oxide.

In some embodiments of the invention, the fragmentable electron donating compound contains a light absorbing group, Z, which is attached directly or indirectly to X, a silver halide absorptive group, A, directly or indirectly attached to X, or a chromophore forming group, Q. which is attached to X. Such fragmentable electron donating compounds are preferably of the following formulae:

$Z—(L—X—Y')_k$ $A—(L—X—Y')_k$ $(A—L)_k—X—Y'$

Q—X—Y'

$A—(X—Y')_k$ $(A)_k—X—Y'$ $Z—(X—Y)_K$ or $(Z)_k—X—Y'$

Z is a light absorbing group;

k is 1 or 2;

A is a silver halide adsorptive group that preferably contains at least one atom of N, S, P, Se, or Te that promotes adsorption to silver halide;

L represents a linking group containing at least one C, N, S, P or O atom; and

Q represents the atoms necessary to form a chromophore comprising an amidinium-ion, a carboxyl-ion or dipolar-amidic chromophoric system when conjugated with X—Y'.

Z is a light absorbing group including, for example, cyanine dyes, complex cyanine dyes, merocyanine dyes, complex merocyanine dyes, homopolar cyanine dyes, styryl dyes, oxonol dyes, hemioxonol dyes, and hemicyanine dyes.

Preferred Z groups are derived from the following dyes:

Dye 1

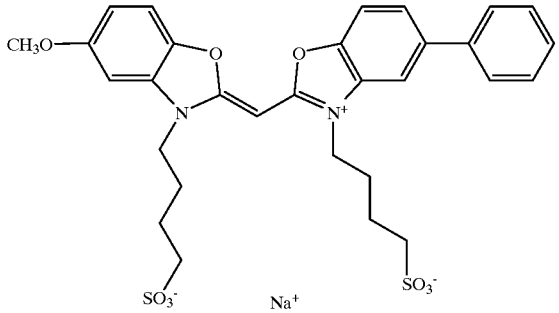

Dye 2

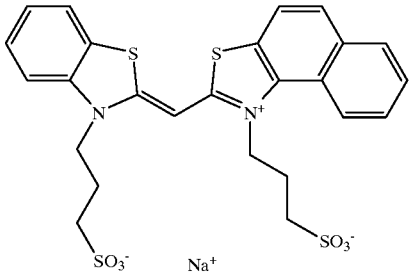

Dye 3

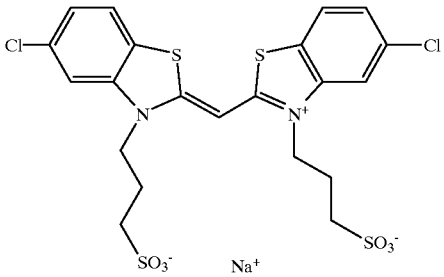

-continued

Dye 4

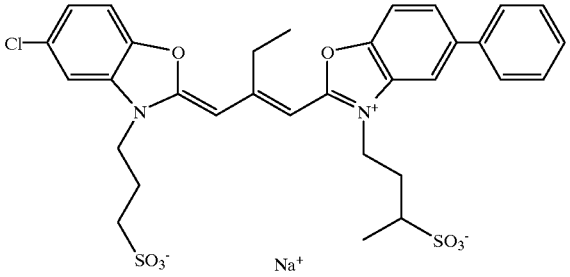

Dye 5

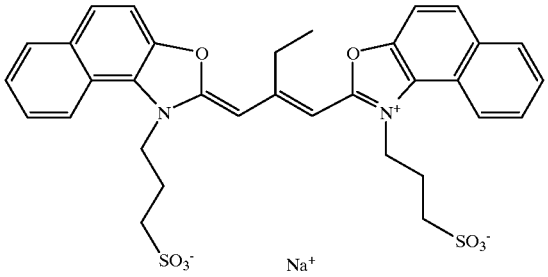

Dye 6

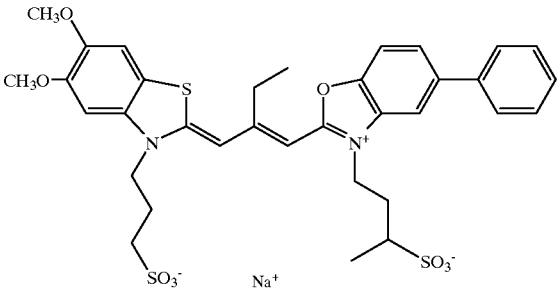

Dye 7

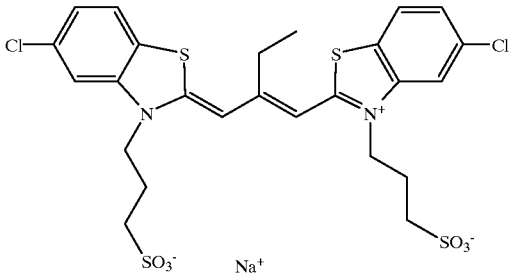

and

Dye 8

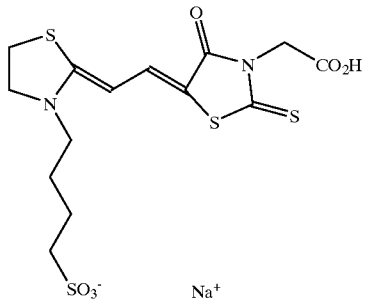

The linking group L may be attached to the dye at one (or more) of the heteroatoms, at one (or more) of the aromatic or heterocyclic rings, or at one (or more) of the atoms of the polymethine chain, at one (or more) of the heteroatoms, at one (or more) of the aromatic or heterocyclic rings, or at one (or more) of the atoms of the polymethine chain. For simplicity, and because of the multiple possible attachment sites, the attachment of the L group is not specifically indicated in the generic structures.

The silver halide adsorptive group A is preferably a silver-ion ligand moiety or a cationic surfactant moiety. In preferred embodiments, A is selected from the group consisting of: i) sulfur acids and their Se and Te analogs; ii) nitrogen acids, iii) thioethers and their Se and Te analogs, iv) phosphines, v) thionamides, selenamides, and telluramides, and vi) carbon acids.

Illustrative A groups include:

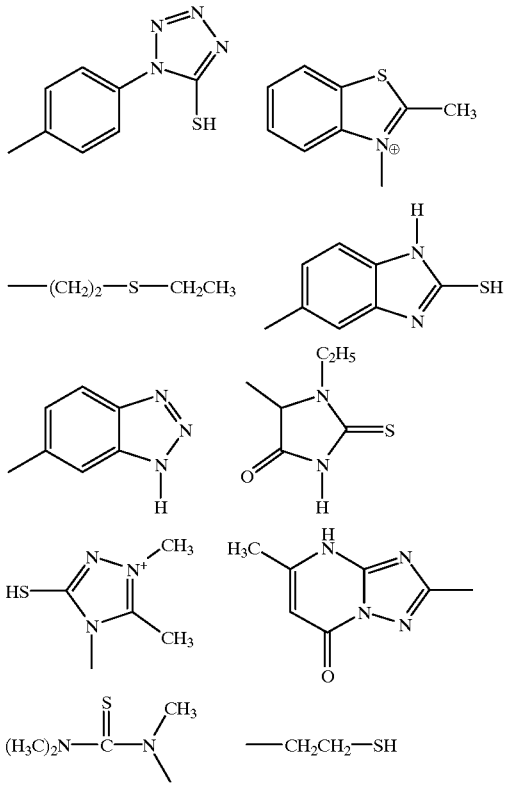

and

The point of attachment of the linking group L to the silver halide adsorptive group A will vary depending on the structure of the adsorptive group, and may be at one (or more) of the heteroatoms, at one (or more) of the aromatic or heterocyclic rings.

The linkage group represented by L which connects by a covalent bond the light absorbing group Z or the silver halide adsorbing group A to the fragmentable electron donating group XY is preferably an organic linking group containing a least one C, N, S, or O atom. It is also desired that the linking group not be completely aromatic or unsaturated, so that a pi-conjugation system cannot exist between the Z and XY or the A and XY moieties. Preferred examples of the linkage group include, an alkylene group, an arylene group, —O—, —S—, —C═O, —$SO_2$—, —NH—, —P═O, and —N═. Each of these linking components can be optionally substituted and can be used alone or in combination. Examples of preferred combinations of these groups are:

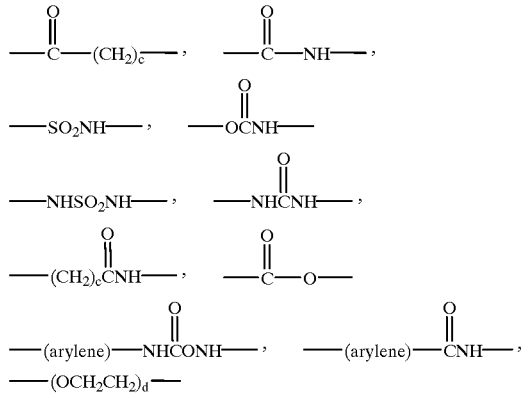

where c=1–30, and d=1–10

The length of the linkage group can be limited to a single atom or can be much longer, for instance up to 30 atoms in length. A preferred length is from about 2 to 20 atoms, and most preferred is 3 to 10 atoms. Some preferred examples of L can be represented by the general. formulae indicated below:

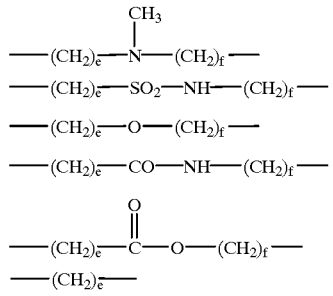

e and f=1–30, with the proviso that e+f≦31

Q represents the atoms necessary to form a chromophore comprising an amidinium-ion, a carboxyl-ion or dipolar-amidic chromophoric system when conjugated with X—Y'. Preferably the chromophoric system is of the type generally found in cyanine, complex cyanine, hemicyanine, merocyanine, and complex merocyanine dyes as described in F. M. Hamer, *The Cyanine Dyes and Related Compounds* (Interscience Publishers, New York, 1964).

Illustrative Q groups include:

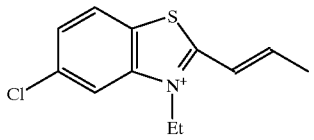

-continued

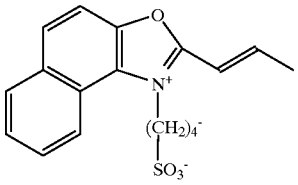

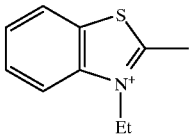

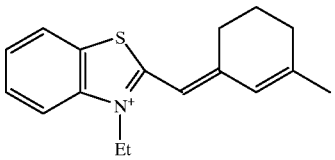

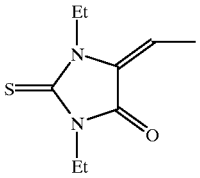

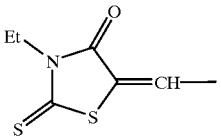

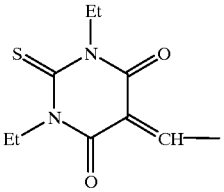

-continued

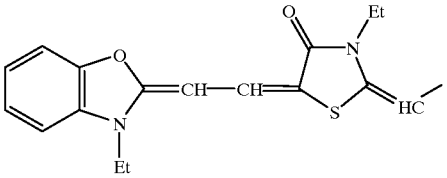

Particularly preferred are Q groups of the formula:

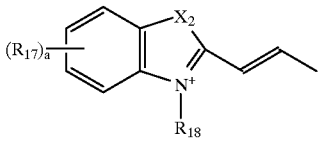

wherein:

$X_2$, is O, S, N, or $C(R_{19})_2$, where $R_{19}$ is substituted or unsubstituted alkyl.

each $R_{17}$ is independently a hydrogen atom, a halogen atom, a substituted or unsubstituted alkyl group, or substituted or unsubstituted aryl group;

a is an integer of 1–4; and $R_{18}$ is substituted or unsubstituted alkyl, or substituted or unsubstituted aryl.

Illustrative fragmentable electron donating compounds include:

FED 1

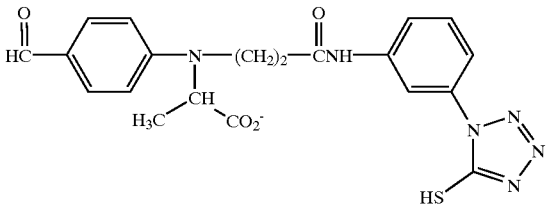

FED 2

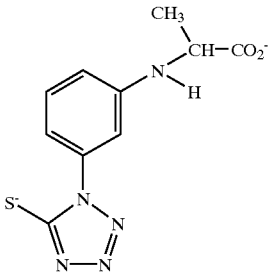

FED 3

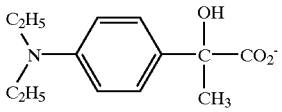

-continued
FED 4
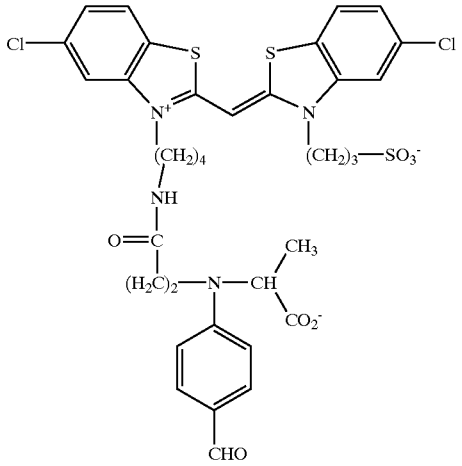
FED 5
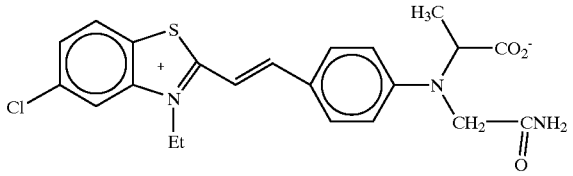
FED 6
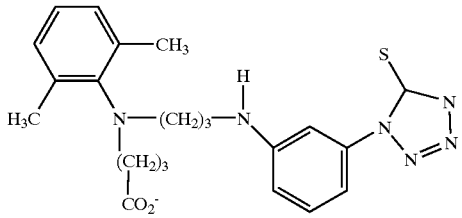
FED 7
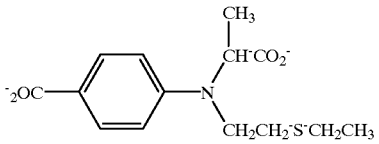
FED 8
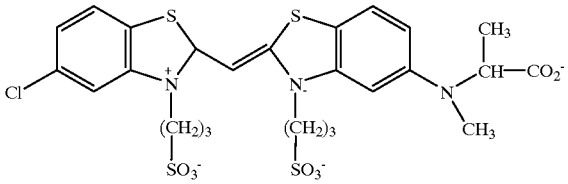
FED 9
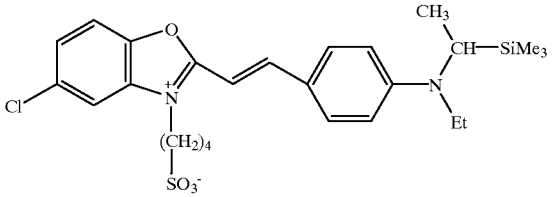

-continued
FED 10
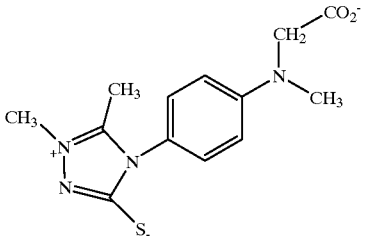
FED 11
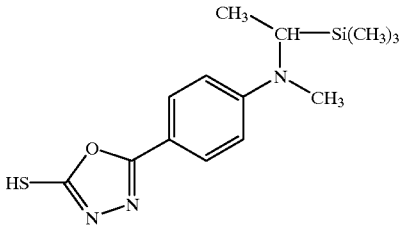
FED 12
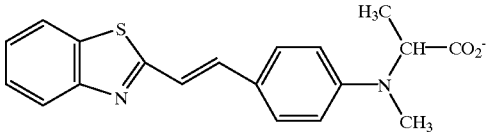
FED 13
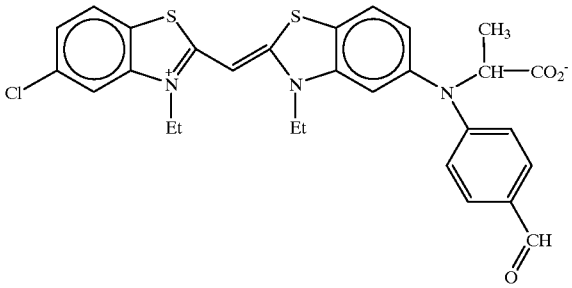
FED 14
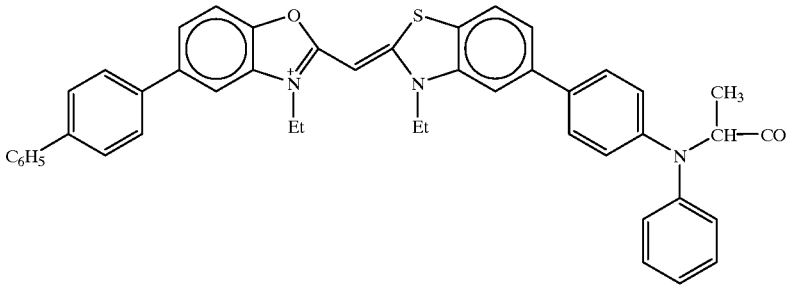
FED 15
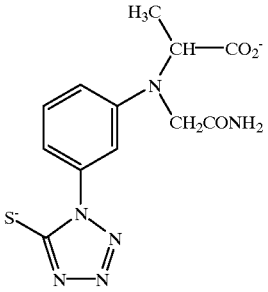

-continued
FED 16
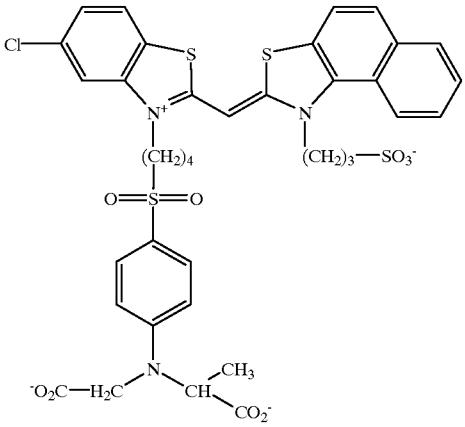
FED 17
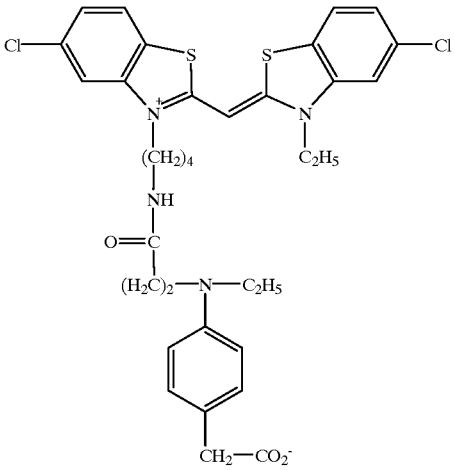
FED 18
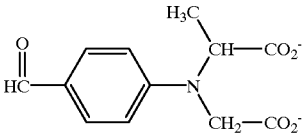
FED 19
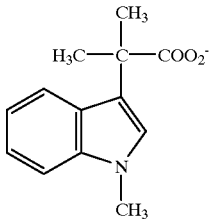
FED 20
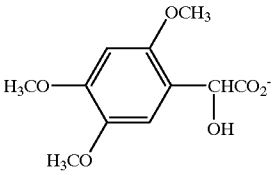

-continued

FED 21

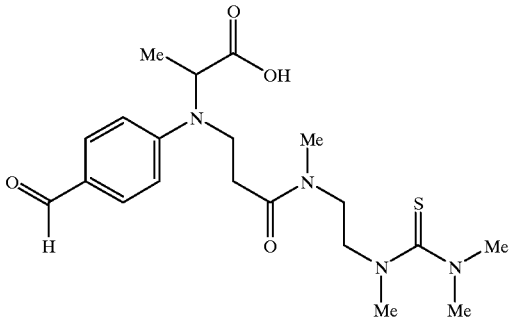

FED 22

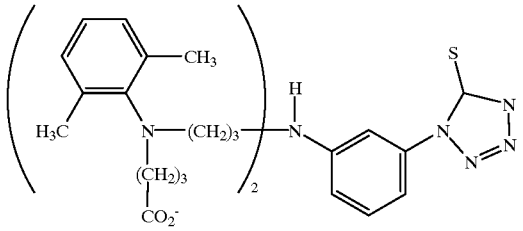

The fragmentable electron donors of the present invention can be included in a silver halide emulsion by direct dispersion in the emulsion, or they may be dissolved in a solvent such as water, methanol or ethanol for example, or in a mixture of such solvents, and the resulting solution can be added to the emulsion. The compounds of the present invention may also be added from solutions containing a base and/or surfactants, or may be incorporated into aqueous slurries or gelatin dispersions and then added to the emulsion. The fragmentable electron donor may be used as the sole sensitizer in the emulsion. However, in preferred embodiments of the invention a sensitizing dye is also added to the emulsion. The compounds can be added before, during or after the addition of the sensitizing dye. The amount of electron donor which is employed in this invention may range from as little as $1\times10^{-8}$ mole per mole of silver in the emulsion to as much as about 0.1 mole per mole of silver, preferably from about $5\times10^{-7}$ to about 0.05 mole per mole of silver. Where the fragmentable two-electron donor has a relatively lower potential it is more active, and relatively less agent need be employed. Conversely, where the fragmentable two-electron donor has a relatively higher first oxidation potential a larger amount thereof, per mole of silver, is. employed. For fragmentable one-electron donors relatively larger amounts per mole of silver are also employed. Although it is preferred that the fragmentable electron donor be added to the silver halide emulsion prior to manufacture of the coating, in certain instances, the electron donor can also be incorporated into the emulsion after exposure by way of a pre-developer bath or by way of the developer bath itself.

Fragmentable electron donating compounds are described more fully in U.S. Pat. Nos. 5,747,235 and 5,747,236 and commonly assigned co-pending U.S. applications Ser. No. 08/739,911 filed Oct. 30, 1996, and Ser. Nos. 09/118,536, 09/118,552 and 09/118,714 filed Jul. 25, 1998, the entire disclosures of these patents and patent applications are incorporated herein by reference.

The silver halide used in the photographic elements may be silver iodobromide, silver bromide, silver chloride, silver chlorobromide, silver chloroiodobromide, and the like.

The type of silver halide grains can be polymorphic, cubic, and octahedral. The grain size of the silver halide may have any distribution known to be useful in photographic compositions, and may be either polydipersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers ($\mu$m). The tabular grains can be of any thickness compatible with achieving an aim average aspect ratio and/or average tabularity of the tabular grain emulsion. Preferably the tabular grains satisfying projected area requirements are those having thicknesses of <0.3 $\mu$m, thin (<0.2 $\mu$m) tabular grains being specifically preferred and ultrathin (<0.07 $\mu$m) tabular grains being contemplated for maximum tabular grain performance enhancements. When the native blue absorption of iodohalide tabular grains is relied upon for blue speed, thicker tabular grains, typically up to 0.5 $\mu$m in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B.(3) (page 503). Preferred silver halide emulsions for use in this invention comprise high bromide {111} grains.

The photographic elements of the invention provide the silver halide in the form of an emulsion. The photographic emulsion includes a gelatin vehicle which can be present during and after formation of the emulsion. The vehicle can be gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I*. Gelatin can be present in the emulsion in any amount useful in photographic emulsions.

The silver halide photographic elements of the invention are color photographic elements. The color photographic element can be single color photographic elements, but are preferable multicolor elements generally comprising three dye image forming layer units. At least one dye image providing coupler and at least one electron transfer agent releasing compound are present in a dye image forming layer unit of the photographic element. The term "coupler" is employed in its art recognized sense of denoting a compound that selectively reacts with oxidized (as opposed to non-oxidized) primary amine color developer agent during photographic element development. Dye image forming couplers complete a dye chromophore upon coupling. The term "electron transfer agent" or ETA is employed in its art recognized sense of denoting a silver halide developing agent that donates an electron (becomes oxidized) in reducing $Ag^+$ in silver halide to silver $Ag^\circ$ and is then regenerated to its original non-oxidized state by entering into a redox reaction with primary amine color developing agent. In the redox reaction the color developing agent is oxidized and hence activated for coupling. Since ETA cycles between reactions with the silver halide grains and the color developing agent during development, it is not depleted during use, therefore very small amounts of ETA are highly effective.

A preferred photographic element according to this invention comprises a compound capable of release of an electron transfer agent which has the structural formula:

$$CAR—(L')_n—ETA$$

or $$B—ETA$$

wherein:

CAR is a carrier moiety which is capable of releasing $—(L')_n—ETA$ on reaction with a component of the developing solution, an especially preferred embodiment of CAR being a coupler moiety COUP which can release $—(L')_n—ETA$ during reaction with oxidized primary amine color developing agent;

n is 0, 1, or 2;

L' represents a divalent linking group which may be of the same or different type when more than one L' moiety is present; and ETA is preferably a 1-aryl-3-pyrazolidinone derivative, a hydroquinone or derivative thereof, a catechol or derivative thereof, or an acylhydrazine or derivative thereof, attached to L', which upon release from $—(L')_n—$ is unblocked and becomes an active electron transfer agent capable of accelerating development under processing conditions used to obtain the desired dye image. B representing a blocking group moiety that releases ETA on reaction with a component of the developing solution.

Hereinafter, ETA refers to electron transfer agent; ETARC (electron-transfer-agent releasing coupler) refers to the preferred embodiment of $CAR—(L')_n—ETA$ wherein CAR is a coupler moiety COUP, and B—ETA refers to a blocked ETA.

On reaction with a component of the developing solution during processing, the CAR moiety releases the $—(L')_n—$ ETA fragment which is capable of releasing an electron transfer agent. The electron transfer agent participates in the color development process to increase the rate of silver halide reduction and color developer oxidation resulting in enhanced detection of exposed silver halide grains and the consequent improved image dye density. Depending upon the nature of the $—(L')_n$-moiety in the above-noted structural formula, release of—ETA can be delayed so that the effect of accelerated silver halide development can be more readily controlled.

The electron transfer agent pyrazolidinone moieties which have been found to be useful in providing development acceleration function are derived from compounds generally of the type described in U.S. Pat. Nos. 4,209,580; 4,463,081; 4,471,045; and 4,481,287 and in published Japanese patent application No. 62-123, 172. Such compounds comprise a 3-pyrazolidinone structure having an unsubstituted or substituted aryl group in the 1-position. Preferably these compounds have one or more alkyl groups in the 4 or 5-positions of the pyrazolidinone ring.

Preferred 1-aryl-3-pyrazolidinone derivative electron transfer agents suitable for use in this invention are represented by structural formulae I' and II':

(I')

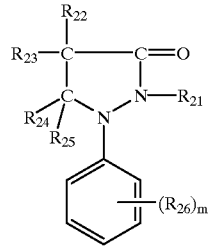

(II')

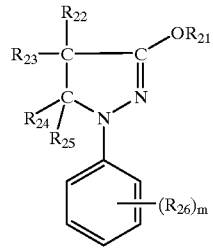

wherein:

$R_{21}$ is hydrogen; $R_{22}$ and $R_{23}$ each independently represents hydrogen, substituted or unsubstituted alkyl having from 1 to about 12 carbon atoms, $CH_2OR'$ or $CH_2OC(O)R'$ where R' can be a substituted or unsubstituted alkyl, aryl or a heteroatom containing group, carbamoyl, or substituted or unsubstituted aryl having from 6 to about 10 carbon atoms;

$R_{24}$ and $R_{25}$ each independently represents hydrogen, substituted or unsubstituted alkyl having from 1 to about 8 carbon atoms or substituted or unsubstituted aryl having from 6 to about 10 carbon atoms;

$R_{26}$, which may be present in the ortho, meta or para positions of the benzene ring, represents halogen, substituted or unsubstituted alkyl having from 1 to about 8 carbon atoms, or substituted or unsubstituted alkoxy having from 1 to about 8 carbon atoms, or sulfonamido, and when m is greater than 1, the $R_{26}$ substituents can be the same or different or can be taken together to form a carbocyclic or a heterocyclic ring, for example a benzene or an alkylenedioxy ring; and m is 0 or 1 to 3.

When $R_{22}$ and $R_{23}$ groups are alkyl it is preferred that they comprise from 4 to 12 carbon atoms. When $R_{22}$ and $R_{23}$ represent aryl, they are preferably phenyl. When $R_{22}$ and $R_{23}$ are $CH_2OR'$ or $CH_2OC(O)R'$ groups, and R' is a substituted or unsubstituted alkyl or aryl group, it is preferred that $R^{22}$ and $R^{23}$ comprise from 3 to 8 carbon atoms. When R' is a heteroatom containing group it is preferred that $R_{22}$ and $R_{23}$ comprise from 4 to 12 carbon atoms. R' may contain, for example, a morpholino, imidazole, triazole or tetrazole group, or a sulfide or ether linkage.

$R_{24}$ and $R_{25}$ are preferably hydrogen.

When $R_{26}$ represents sulfonamido, it may be, for example, methanesulfonamido, ethanesulfonamido or toluenesulfonamido.

Preferred hydroquinone or derivative thereof electron transfer agents are of the formula:

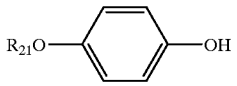

Preferred catechol or derivative thereof electron transfer agents are of th formula:

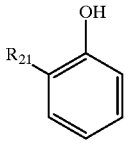

wherein $R_{21}$ is defined above.

Preferred acylhydrazine or derivatives thereof, ETA is represented by the following formulae:

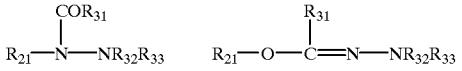

wherein $R_{31}$, $R_{32}$ and $R_{33}$ each represents a hydrogen atom, an alkyl group an aryl group or a heterocyclic group and $R_{31}$ and $R_{32}$, $R_{32}$ and $R_{33}$ may be linked to each other to form a ring, preferably a 5- or 6-membered nitrogen atom-containing heterocyclic ring. $R_{21}$ is as defined above.

Especially preferred releasable electron transfer agents, suitable for use in this invention and falling within the above tautomeric structural formulas I' II' (where $R_{21}$ is hydrogen), are presented in Table I'.

TABLE I

| ETA No. | $R_{22}$ | $R_{23}$ | $R_{26}$ |
|---|---|---|---|
| 1 | —H | —H | —H |
| 2 | —$CH_3$ | —H | —H |

TABLE I-continued

| ETA No. | $R_{22}$ | $R_{23}$ | $R_{26}$ |
|---|---|---|---|
| 3 | —$CH(CH_3)_2$ | —H | —H |
| 4 | —$CH_3$ | —$CH_2OH$ | —H |
| 5 | —H | —H | p-$CH_3$ |
| 6 | —H | —H | p-$OCH_3$ |
| 7 | —$CH_3$ | —$CH_2OH$ | p-$CH_3$ |
| 8 | —$CH_3$ | —$CH_2OH$ | p-$OCH_3$ |
| 9 | $CH_3$ | $CH_2OC(O)iPr$ | H |
| 10 | $CH_3$ | $CH_2OC(O)tBu$ | H |
| 11 | $CH_3$ | $CH_2OC(O)Et$ | p-$CH_3$ |
| 12 | $CH_3$ | $CH_2OC(O)Et$ | 3,4-dimethyl |
| 13 | H | $CH_2OC_4H_9$-n | p-$OCH_3$ |
| 14 | $CH_3$ | $CH_2OC(O)CH_2$—O—$(CH_2)_2S(CH_2)_2SMe$ | H |

The ETA is attached to the releasing or blocking moiety at a position that will cause the ETA to be inactive until released or unblocked. In structure I' or II' the point of attachment of the ETA to the CAR, or to the CAR—$(L')_n$-linking moiety, or to the blocking moiety is that point where $R_{21}$—is attached after release. Such attachment inactivates the ETA moiety so that it is unlikely to cause undesirable reactions during storage of the photographic material. However, the oxidized developer formed in an imagewise manner as a consequence of silver halide development reacts with the CAR moiety to cleave the bond between CAR and L'. Thereafter, subsequent reaction, not involving an oxidized developing agent, breaks the bond linking L' and the blocked ETA to release the active ETA moiety.

The linking group —$(L')_n$—, where it is present in the compounds described herein, is employed to provide for controlled release of the ETA pyrazolidinone moiety from the coupler moiety so that the effect of accelerated silver halide development can be quickly attained.

Various types of known linking groups can be used. These include quinonemethide linking groups such as are disclosed in U.S. Pat. No. 4,409,323; pyrazolonemethide linking groups such as are disclosed in U.S. Pat. No. 4,421,845; and intramolecular nucleophilic displacement type linking groups such as are disclosed in U.S. Pat. No. 4,248,962 and in European patent application Nos. 193,389 and 255,085, the disclosures of which are incorporated herein by reference.

Illustrative linking groups include, for example,

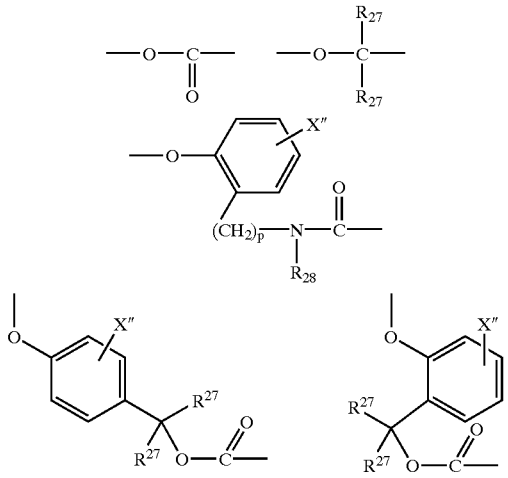

-continued

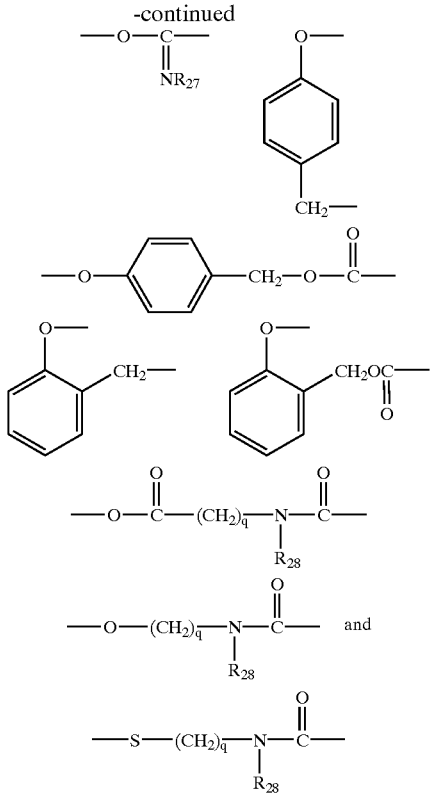

wherein each $R_{27}$ can independently be hydrogen, alkyl (preferably of 1 to 10 carbon atoms), or aryl (preferably of 6 to 12 carbon atoms); $R_{28}$ is alkyl (preferably of 1 to 20 carbon atoms, more preferably of 1 to 4 carbon atoms); aryl (preferably of 6 to 20 carbon atoms, more preferably 6 to 10 carbon atoms); X" is — $NO_2$, —CN, sulfone, halogen or alkoxycarbonyl; and p is 0 or 1 and q is from 1 to 4.

CAR carrier moieties capable, when triggered by reaction with a component of the developing solution, of releasing a photographically useful group (PUG) are particularly well-known in development inhibitor release (DIR) technology where the PUG is a development inhibitor. Typical references to hydroquinone type carriers are U.S. Pat. Nos. 3,379,529, 3,297,445, and 3,975,395. U.S. Pat. No. 4, 108, 663 discloses similar release from aminophenol and aminonaphthol carriers, while U.S. Pat. No. 4,684,604 features PUG-releasing hydrazide carriers. All of these may be classified as redox-activated carriers for PUG release. Non-imagewise release of PUG, relying on reaction between the blocking group and a component of the developing solution, is disclosed in U.S. Pat. Nos. 5,019,492 and 5,554,492.

A far greater body of knowledge has been built up over the years on carriers in which a coupler moiety COUP releases a PUG upon reacting with an oxidized primary amine color developing agent. These can be classified as coupling-activated carriers. Representative are U.S. Pat. Nos. 3,148,062, 3,227,554, 3,617,291, 3,265,506, 3,632, 345, and 3,660,095.

The COUP, from which the preferred electron transfer agent pyrazolidinone moiety is released, includes coupler moieties employed in conventional color-forming photographic processes which yield colored products based on reactions of couplers with oxidized color developing agents. The couplers can be moieties which yield colorless products on reaction with oxidized color developing agents. The couplers can also form dyes which are unstable and which decompose into colorless products. Further, the couplers can provide dyes which wash out of the photographic recording materials during processing. Such coupler moieties are well known to those skilled in the art.

The COUP moiety can be unballasted or ballasted with an oil-soluble or fat-tail group. It can be monomeric, or it can form part of a dimeric, oligomeric or polymeric coupler, in which case more than one ETA moiety or $—(L')_n—$ETA moiety can be contained in the ETA releasing compound.

Many COUP moieties are known. The dyes formed therefrom generally have their main absorption in the red, green, or blue regions of the visible spectrum. For example, couplers which form cyan dyes upon reaction with oxidized color developing agents are described in such representative patents and publications as: U.S. Pat. Nos. 2,772,162; 2,895, 826; 3,002,836; 3,034,892; 2,474,293; 2,423,730; 2,367, 531; 3,041,236; 4,333,999; and "Farbkuppler: Eine Literaturubersicht," published in Agfa Mitteilungen, Band III, pp. 156–175 (1961). In the coupler moiety structures shown below, the unsatisfied bond indicates the coupling position to which $—(L')_n—$ETA may be attached.

Preferably such couplers are phenols and naphthols which form cyan dyes on reaction with oxidized color developing agent at the coupling position, i.e. the carbon atom in the 4-position of the phenol or naphthol. Structures of such preferred cyan coupler moieties are:

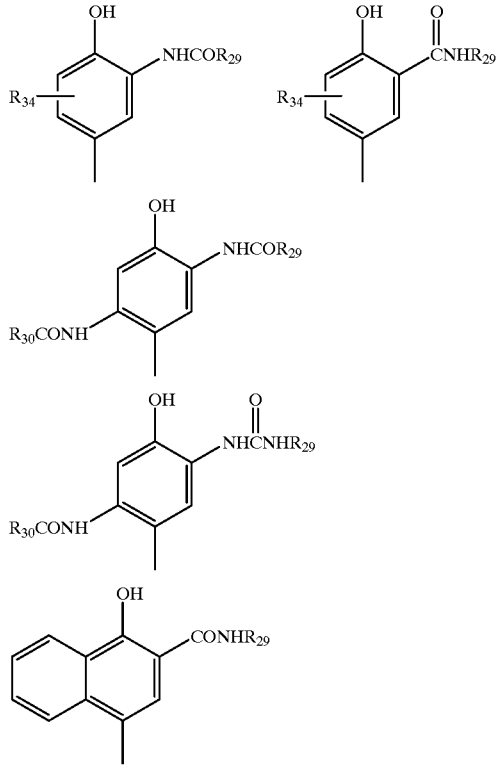

where $R_{29}$ and $R_{30}$ can represent a ballast group or a substituted or unsubstituted alkyl or aryl group, and $R_{34}$ represents one or more halogen (e.g. chloro, fluoro), alkyl having from 1 to 4 carbon atoms or alkoxy having from 1 to 4 carbon atoms.

Other suitable couplers include for example,

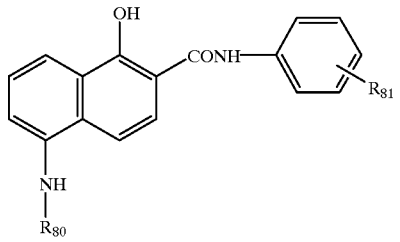

wherein $R_{81}$ is a ballast group and $R_{80}$ is $SO_2NHR_{82}$ or $C(O)R_{82}$, where $R_{82}$ is an alkyl group.

Couplers which form magenta dyes upon reaction with oxidized color developing agent are described in such representative patents and publications as: U.S. Pat. Nos. 2,600,788; 2,369,489; 2,343,703; 2,311,082; 3,824,250; 3,615,502; 4,076,533; 3,152,896; 3,519,429; 3,062,653; 2,908,573; 4,540,654; and "Farbkuppler: Eine Literaturubersicht," published in Agfa Mitteilungen, Band III, pp. 126–156 (1961).

Preferably such couplers are pyrazolones and pyrazolotriazoles which form magenta dyes upon reaction with oxidized color developing agents at the coupling position, i.e. the carbon atom in the 4-position for pyrazolones and the 7-position for pyrazolotriazoles. Structures of such preferred magenta coupler moieties are:

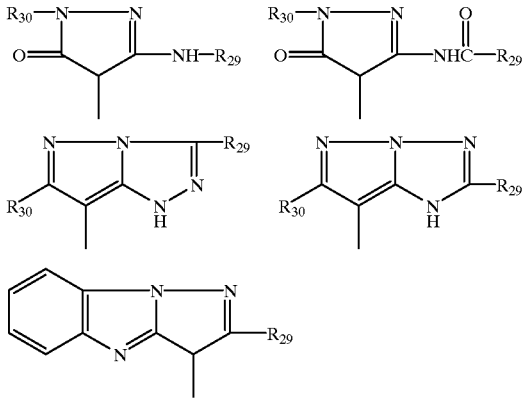

wherein $R_{29}$ and $R_{30}$ are as defined above; $R_{30}$ for pyrazolone structures is typically phenyl or substituted phenyl, such as for example 2,4,6-trihalophenyl, and for the pyrazolotriazole structures $R_{30}$ is typically alkyl or aryl.

Couplers which form yellow dyes upon reaction with oxidized color developing agent are described in such representative patents and publications as: U.S. Pat. Nos. 2,875,057; 2,407,210; 3,265,506; 2,298,443; 3,048,194; 3,447,928; and "Farbkuppler: Eine Literaturubersicht," published in Agfa Mitteilungen, Band III, pp. 112–126 (1961).

Preferably such yellow dye-forming couplers are acylacetamides, such as benzoylacetanilides and pivalylacetanilides. These couplers react with oxidized developer at the coupling position, i.e. the active methylene carbon atom

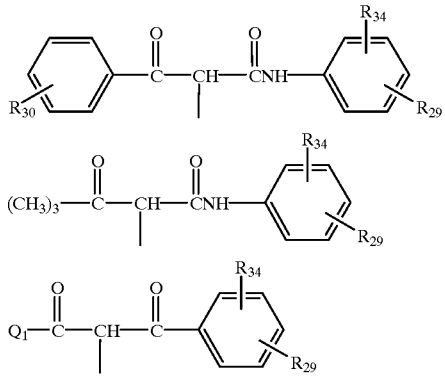

where $R_{29}$ and $R_{30}$ are as defined above and can also be hydrogen, alkoxy, alkoxycarbonyl, alkanesulfonyl, arenesulfonyl, aryloxycarbonyl, carbonamido, carbamoyl, sulfonamido, or sulfamoyl, $R_{34}$ is hydrogen or one or more halogen, lower alkyl (e.g. methyl, ethyl), lower alkoxy (e.g. methoxy, ethoxy), or a ballast (e.g. alkoxy of 16 to 20 carbon atoms) group and $Q_1$ is an alicyclic or heterocyclic group (e.g. cyclopropyl or indole).

Other preferred COUP moieties of the type found in yellow dye-forming couplers are of the formula:

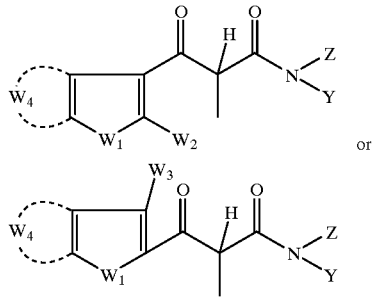

wherein:

$W_1$ is a heteroatom or heterogroup, preferably —NR—, —O—, —S—, —$SO_2$—;

$W_2$ is H, or a substituent group, such as an alkyl or aryl group;

$W_3$ is H, or a substituent group, such as an alkyl or aryl group;

$W_4$ represents the atoms necessary to form a fused ring with the ring containing W, preferably a benzo group;

Y and Z are independently H or a substituent group, preferably Y is H and Z is a substituted phenyl group.

Other preferred COUP moieties of the type found in yellow dye-forming couplers are of the formula:

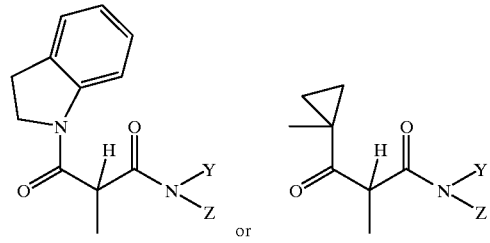

wherein Y and Z are independently H or a substituent group, preferably Y is H and Z is a substituted phenyl group. Further examples of yellow dye forming COUP moieties are:

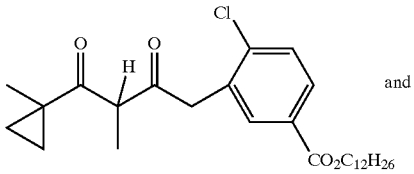

and

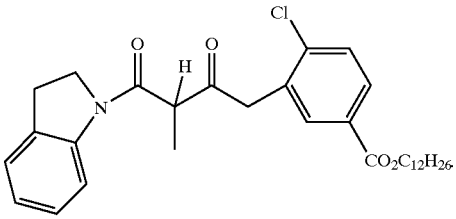

Couplers which form colorless products upon reaction with oxidized color developing agent are described in such representative patents as: U.K. Pat. No. 861,138 and U.S. Pat. Nos. 3,632,345, 3,928,041, 3,958,993 and 3,961,959. Preferably, such couplers are cyclic carbonyl containing compounds which form colorless products on reaction with oxidized color developing agent and have the L' group attached to the carbon atom in the ox-position with respect to the carbonyl group.

Structures of such preferred coupler moieties are:

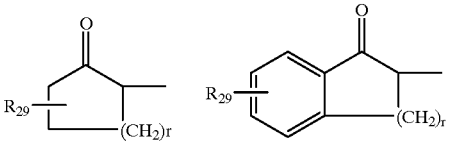

-continued

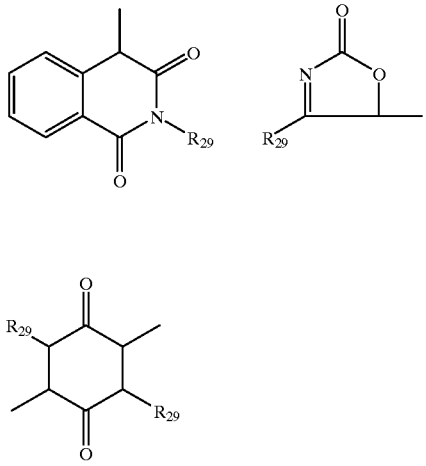

where $R_{29}$ is as defined above, and r is 1 or 2 .

It will be appreciated that, depending upon the particular coupler moiety, the particular color developing agent and the type of processing, the reaction product of the coupler moiety and oxidized color developing agent can be: (1) colored and non-diffusible, in which case it will remain the location where it is formed; (2) colored and diffusible, in which case it may be removed during processing from the location where it is formed or allowed to migrate to a different location; or (3) colorless and diffusible or non-diffusible, in which case it will not contribute to image density. Where it is desirable for such a reaction product to be removable during processing, the groups R9 and R10 in the above structures can additionally be hydrogen when attached to an NH group or to a ring carbon atom.

Especially preferred structures for CAR—$(L')_n$—ETA compounds include the following:

ETARC-1

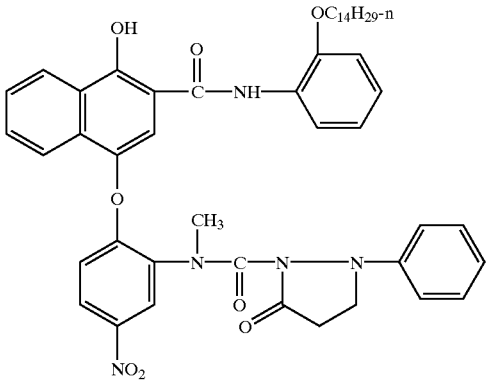

-continued
ETARC-2
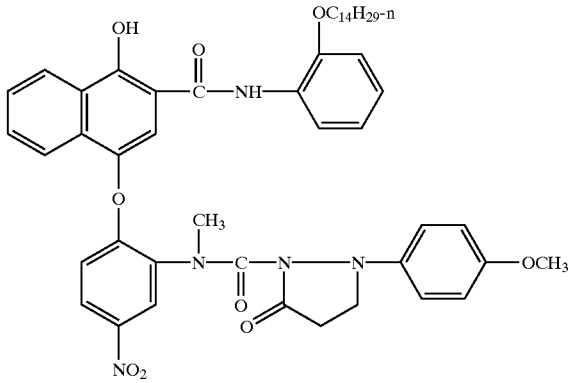
ETARC-3
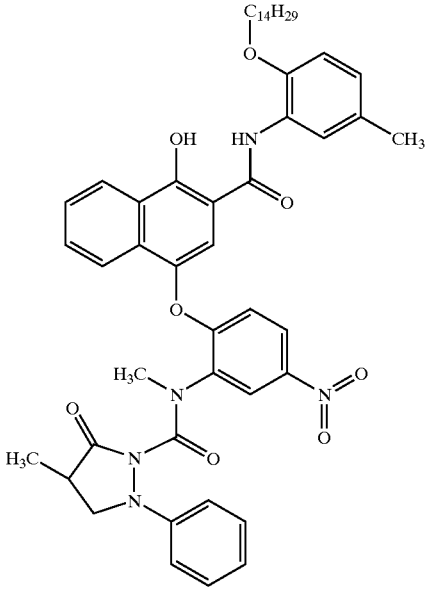
ETARC-4
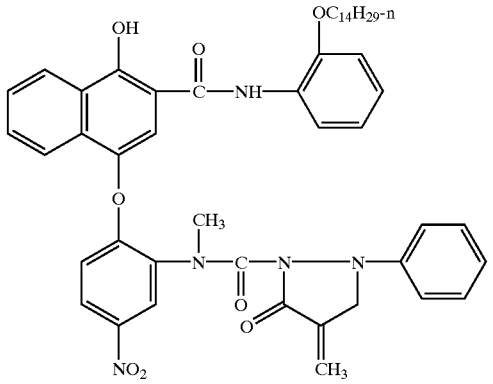

-continued
ETARC-5
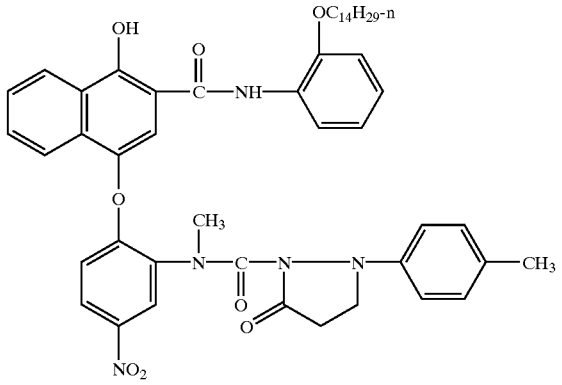
ETARC-6
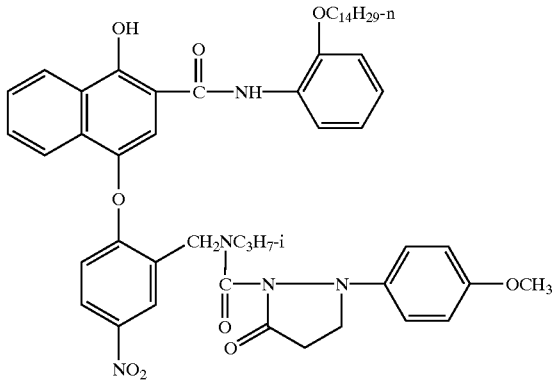
ETARC-7
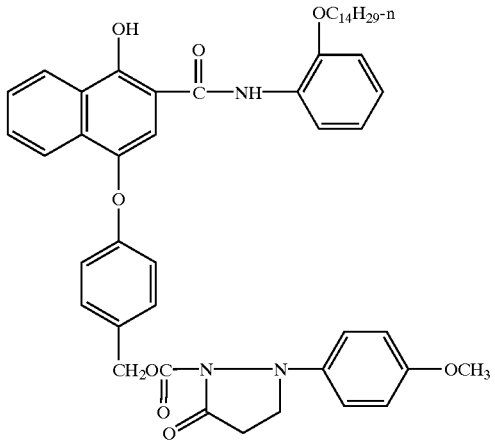
ETARC-8
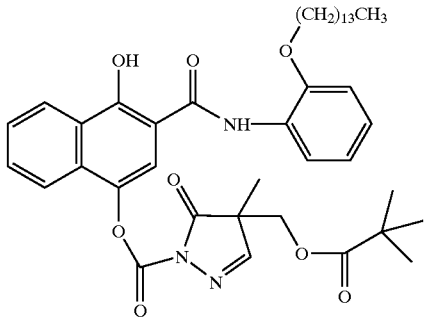

-continued
ETARC-9
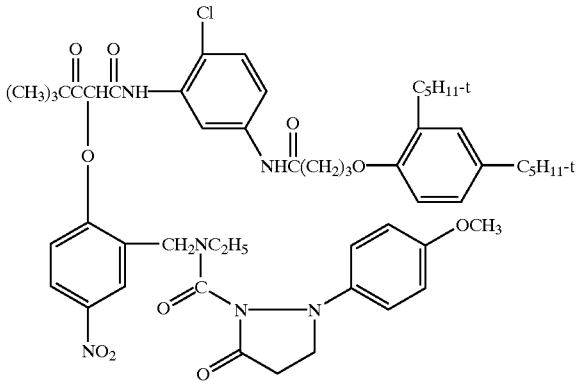
ETARC-10
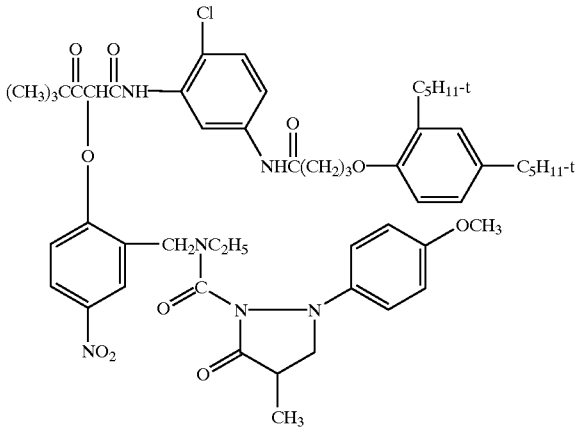
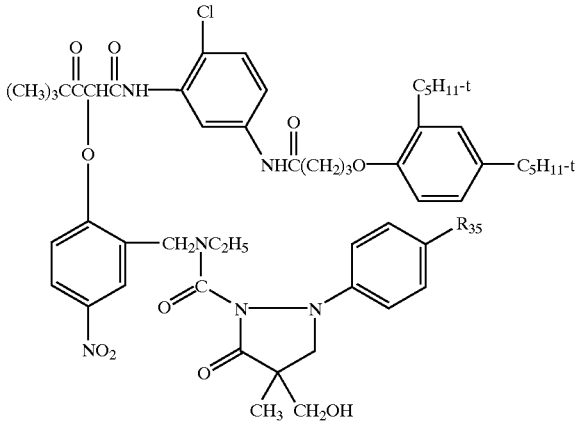
| | $R_{35}$ |
|---|---|
| ETARC-11 | —H |
| ETARC-12 | —$CH_3$ |
| ETARC-13 | —$OCH_3$ |

-continued
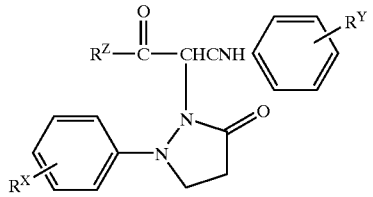
| | $R^x$ | $R^y$ | $R^z$ |
|---|---|---|---|
| ETARC-14 | —H | m-$NHSO_2C_{16}H_{33}$-n | $C_4H_9$-t |
| ETARC-15 | p-$CH_3$ | m-$SO_2NHC_{16}H_{33}$-n | 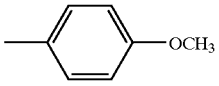 |
| ETARC-16 | p-$OCH_3$ | H | 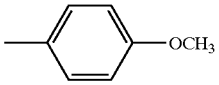 |
ETARC-17
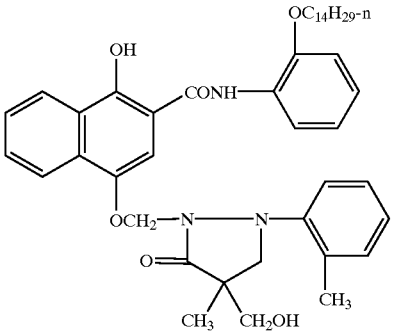
ETARC-18
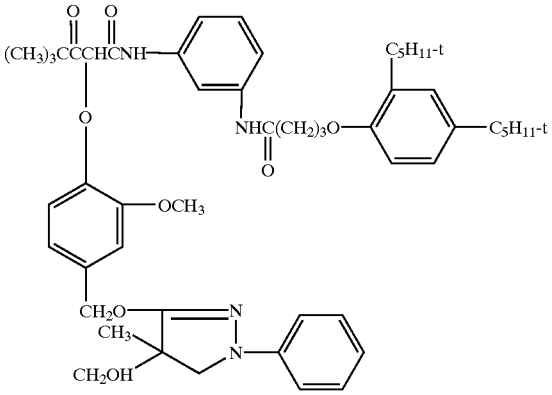
ETARC-19
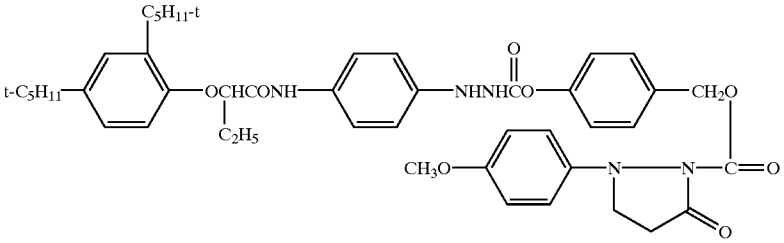

-continued
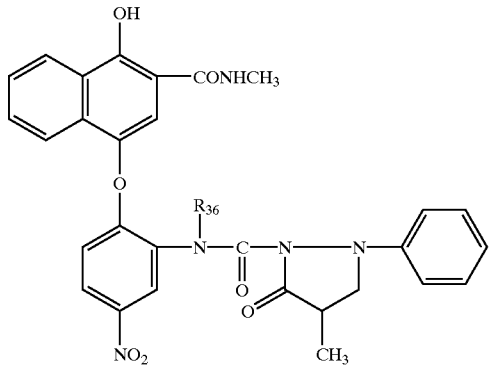
| | $R_{36}$ |
|---|---|
| ETARC-20 | —$CH_3$ |
| ETARC-21 | —$C_{12}H_{25}$ |
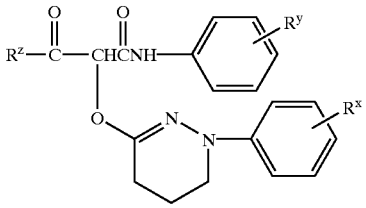
| | $R^x$ | $R^y$ | $R^z$ |
|---|---|---|---|
| ETARC-22 | —H | m-$NHSO_2C_{16}H_{33}$-n | $C_4H_9$-t |
| ETARC-23 | p-$CH_3$ | m-$SO_2NHC_{16}H_{33}$-n | 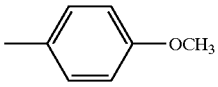 |
| ETARC-24 | p-$OCH_3$ | H | 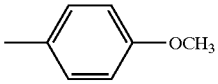 |
ETARC-25
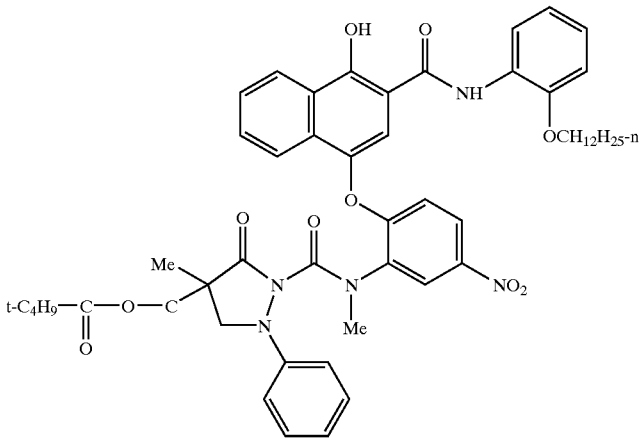

-continued

ETARC-26

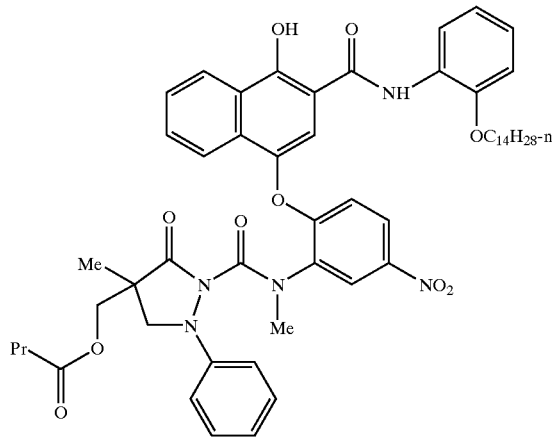

ETARC-27

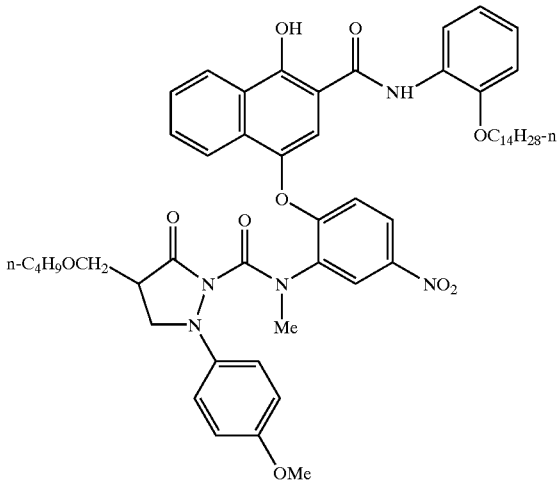

Other illustrations of ETARC couplers are provided by Michno et al U.S. Pat. No. 4,859,578, Platt et al U.S. Pat. No. 4,912,025 and Saito et al U.S. Pat. No. 5,605,786, the disclosures of which are here incorporated by reference.

The following compounds are illustrative electron transfer agent releasing compounds of the formula B—ETA.

A preferred B—ETA compound is represented by the formula:

$$[E_3—(Y_1)_w—E_4—(T_1)_x—(T_2)_y]_{n'}—ETA$$

wherein $E_3$ and $E_4$ are independently electrophilic groups, wherein $E_3$ is more electrophilic than $E_4$;

$T_1$ and $T_2$ are individually releasable timing groups;

$Y_1$ is unsubstituted or substituted atom, preferably a carbon or nitrogen atom, that provides a distance between $E_3$ and $E_4$ that enables a nucleophilic displacement re action to occur with release of ETA upon processing a photographic element containing the blocked photo ETA in the presence of a dinucleophile;

ETA is an electron transfer agent;

w, x and y are independently 0 or 1; and, n' is 1 or 2.

Other preferred B—ETA compounds are of the formula:

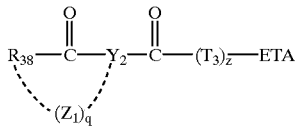

wherein $R_{38}$ is unsubstituted or substituted alkyl, unsubstituted or substituted aryl, or the atoms necessary with $Z_1$ to complete a ring, particularly an alicyclic or heterocyclic ring, with $Y_2$;

$Z_1$ represents the atoms necessary to complete a ring with $R_{38}$ and $Y_2$;

$Y_2$ is a substituted or unsubstituted carbon or nitrogen atom that provides a distance between the carbonyl groups that enables a nucleophilic displacement reaction to occur upon processing a photographic element containing the blocked ETA in the presence of a dinucleophile;

q and z are independently 0 or 1;

$T_3$ is a releasable timing group; and,

ETA is an electron transfer agent.

Highly preferred blocked photographically useful compounds are represented by the formulae:

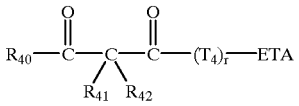

and

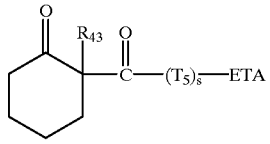

wherein $R_{40}$, $R_{41}$, $R_{42}$ and $R_{43}$ individually are unsubstituted or substituted alkyl or unsubstituted or substituted aryl;

ETA is an electron transfer agent;

$T_4$ and $T_5$ are individually releasable timing groups; and r and s individually are 0 or 1.

$R_{40}$, $R_{41}$, $R_{42}$ and $R_{43}$ are preferably methyl.

The blocking group as described can contain a ballast group. Ballast groups known in the photographic art can be used for this purpose.

The electron transfer agent is released in the presence of a dinucleophile such as hydroxylamine, hydrogen peroxide and monosubstituted hydroxylamine, optionally in a salt form such as acid salts, for example, sulfate or bisulfite salts.

The use of blocking groups of this type is described more fully in U.S. Pat. No. 5,019,492, the entire disclosures of which are incorporated herein by reference.

Other preferred blocked electron transfer agents are of the general formulae:

GF-1

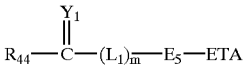

GF-2

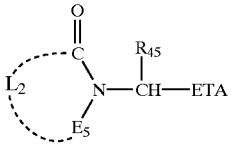

GF-3

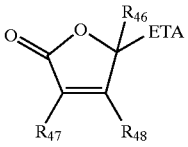

GF-4

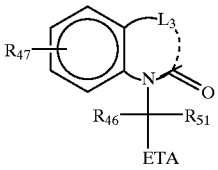

GF-5

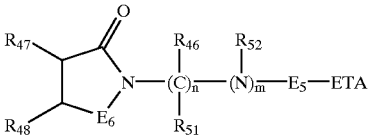

-continued

GF-6

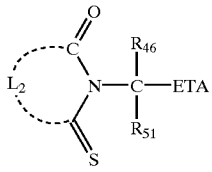

GF-7

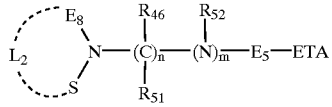

GF-8

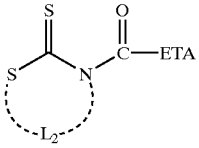

GF-9

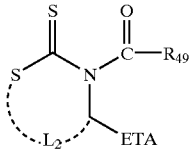

GF-10

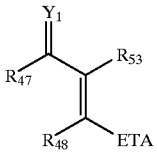

GF-11

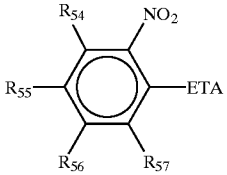

In formula (GF-1), $R_{44}$ a represents the groups having the same meaning as $R_{60}$; $Y_1$ represents an oxygen atom, a sulfur atom, $=N—R_{61}$, or $=C(E_7)—E_8$; $L_1$ represents a divalent linking group containing one or two atoms selected from a carbon atom or a nitrogen atom in the main chain; m represents 0 or 1; $E_1$ represents —CO— or $—SO_2—$; and $E_4$ and $E_5$ each represents an electron attractive group selected from the group consisting of cyano, nitro, $—CO—R_{61}$, $—CO_2R_{62}$, $—CON(R_{63})—R_{61}$, $—SO_2—R_{62}$, and $—SO_2N(R_{63})—R_{61}$. Preferably, $R_{44}$ represents an alkyl group, an aryl group, or a heterocyclic group; $Y_1$ represents an oxygen atom; $L_1$ represents $—C(R_{46})(R_{51})—$, $—C(R_{46})(R_{51})—C(R_{64})(R_{65})—$, $—C(R_{47})=C(R_{48})—$ (wherein $R_{47}$ and $R_{48}$ may be bonded to form a 5- to 7-membered ring), $—C(R_{46})(R_{51})—N(R_{61})—$, or $—(R_{61})—$; m represents 0 or 1; $E_5$ represents —CO— or $—SO_2—$; $R_{46}$, $R_{51}$, $R_{64}$ and $R_{65}$ represent the groups having the same meaning as $R_{61}$; and $R_{47}$ and $R_{48}$ represent the groups having the same meaning as $R_{66}$. More preferably, $R_{44}$ represents an alkyl group or an aryl group; $Y_1$ represents an oxygen atom; $L_1$ represents $—C(R_{46})(R_{51})—$, $—C(R_{47})=C(R_{48})—$ (wherein $R_{47}$ and $R_{48}$ may be bonded to form a 5- to 7-membered unsaturated ring or aromatic ring), or $—N(R_{61})—$; m represents 0 or 1; and $E_5$ represents —CO—.

In formula (GF-2), $E_6$ represents —CO—, $—C=N(R_{63})—$, $—C=C(E_7)—E_8$, or $—SO_2—$; $E_7$ and $E_8$ each represents an electron attractive group; $R_{45}$ represents the groups having the same meaning as $R_{61}$; and $L_2$ represents a nonmetal atomic group necessary to form a 5- to 7-membered ring together with —CO—N—$E_6$—. Preferably, $E_6$ represents —CO—, —C=N($R_{61}$)—, —C=C($E_7$)—$E_8$, or —$SO_2$—; $E_7$ and $E_8$ represents an electron attractive group selected from the group consisting of cyano, nitro, —CO—$R_{61}$, —$CO_2R_{62}$, —CON($R_{63}$)—$R_{61}$, —$SO_2$—$R_{62}$, and —$SO_2$N($R_{63}$)—$R_{61}$; $R_{45}$ represents the groups having the same meaning as $R_{61}$; $L_2$ represents —C($R_{46}$)($R_{47}$)—C($R_{51}$)($R_{48}$)— or —C($R_{47}$)=C($R_{48}$)—; and $R_{46}$, $R_{51}$, $R_{47}$ and $R_{48}$ represent the groups having the same meaning as $R_{46}$, $R_{51}$, $R_{47}$ and $R_{48}$ in formula (GF-1), and $R_{47}$ and $R_{48}$ may be bonded to form a 5- to 7-membered saturated ring, unsaturated ring or aromatic ring. More preferably, $E_6$ represents —CO— or —$SO_2$—; $R_{45}$ represents a hydrogen atom; and $L_2$ represents a substituted or unsubstituted ethylene group or a substituted or unsubstituted 1,2-phenylene group.

In formula (GF-3), $R_{46}$, $R_{47}$ and $R_{48}$ represent the groups having the same meaning as $R_{46}$, $R_{47}$ and $R_{48}$ in formula (GF-1); and $R_{47}$ and $R_{48}$ may be bonded to form a 5- to 7-membered saturated ring, unsaturated ring or aromatic ring.

In formula (GF-4), $R_{46}$, $R_{51}$ and $R_{47}$ represent the groups having the same meaning as $R_{46}$, $R_{51}$ and $R_{47}$ in formula (GF-1); $L_3$ represents a nonmetal atomic group necessary to form a 5- to 7-membered ring; and p represents 0 or an integer of from 1 to 4. Preferably, $L_3$ represents —CO— or —C=N($R_{63}$)—; and $R_{46}$ and $R_{51}$ each represents a hydrogen atom. More preferably, $L_3$ represents —CO—.

In formula (GF-5), R46, $R_{51}$, $R_{47}$ and $R_{48}$ represent the groups having the same meaning as $R_{46}$, $R_{51}$, $R_{47}$ and $R_{48}$ in formula (GF-1), and $R_{47}$ and $R_{48}$ may be bonded to form a 5- to 7-membered saturated ring, unsaturated ring or aromatic ring; $R_{52}$ represents the groups having the same meaning as $R_{63}$; $E_5$ represents —CO— or —$SO_2$—; $E_6$ represents —CO—, —CS—, —C=N($R_{63}$)—, —SO— or —$SO_2$—; n represents 0, 1 or 2; and m represents 0 or 1, and n+m is 1, 2 or 3. Preferably, $E_5$ represents —CO—; $E_6$ represents —CO— or —$SO_2$—; n represents 0, 1 or 2; m represents 0 or 1, and n+m is 1, 2 or 3. More preferably, $E_5$ and $E_6$ represent —CO—; n represents 1, m represents 0; and $R_{46}$ and $R_{51}$ represent hydrogen atoms.

In formula (GF-6), $R_{46}$ and $R_{51}$ represent the groups having the same meaning as $R_{46}$ and $R_{51}$ in formula (GF-1); $L_2$ represents a nonmetal atomic group necessary to form a 5- to 7-membered ring together with —CO—N—CS—. Preferably, $L_2$ represents a substituted or unsubstituted 1,2-phenylene group, a substituted or unsubstituted ethylene group, —C($R_{64}$)($R_{65}$)—S— or —C($R_{64}$)($R_{65}$)—O—; and $R_{64}$ and $R_{65}$ represent the groups having the same meaning as $R_{64}$ and $R_{65}$ in formula (GF-1).

In formula (GF-7), $R_{46}$ and $R_{51}$ represent the groups having the same meaning as $R_{46}$ and $R_{51}$ in formula (GF-1); $R_{52}$ represents the groups having the same meaning as $R_{63}$; $L_2$ represents a nonmetal atomic group necessary to form a 5- to 7-membered ring together with —$E_7$—N—S—; $E_5$ represents —CO— or —$SO_2$—; $E_7$ represents —CO—, —CS—, —C=N($R_{63}$)—, —SO— or —$SO_2$—; n represents 0, 1, 2 or 3; and m and s represent 0 or 1, provided that when m represents 1, s represents 1, and when n represents 0, m and s each represents 1. Preferably, $L_2$ represents a substituted or unsubstituted 1,2-phenylene group, a substituted or unsubstituted ethylene group, —C($R_{64}$)($_{65}$)—S— or —C($R_{64}$)($R_{65}$)—O—; $R_{34}$ and $R_{35}$ represent the groups having the same meaning as $R_{64}$ and $R_{65}$ in formula (GF-1); $E_5$ represents —CO— or —$SO_2$—; $E_7$ represents —CO— or —$SO_2$—; n represents 0 or 1; and m and s each represents 0 or 1, provided that when m represents 1, s represents 1, and when n represents 0, m and s each represents 1. More preferably, $L_2$ represents a substituted or unsubstituted 1,2-phenylene group, or a substituted or unsubstituted ethylene group; $E_5$ represents —CO—; $E_7$ represents —CO— or —$SO_2$—; n represents 1; and m and s each represents 0.

In formula (GF-8), $L_2$ represents a nonmetal atomic group necessary to form a 5- to 7-membered ring together with —S—CS—N—, and preferably a substituted or unsubstituted 1,2-phenylene group, or a substituted or unsubstituted ethylene group.

In formula (GF-9), $R_{49}$ represents the groups having the same meaning as $R_{62}$; $L_2$ represents a nonmetal atomic group necessary to form a 5- to 7-membered ring together with —S—CS—N—, and preferably a substituted or unsubstituted 1,2-phenylene group, or a substituted or unsubstituted ethylene group.

In formula (GF-10), $Y_1$ represents the groups having the same meaning as $Y_1$, in formula GF-1); $R_{53}$ represents the groups having the same meaning as $R_{66}$; and $R_{47}$ and $R_{48}$ represent the groups having the same meaning as $R_{47}$ and $R_{48}$ in formula (GF-1), and $R_{47}$ and $R_{48}$ may be bonded to form a 5- to 7-membered saturated ring, unsaturated ring or aromatic ring.

In formula (GF-11), $R_{54}$ a represents a group selected from the group consisting of cyano, —CO—$R_{61}$, —$CO_2R_{62}$, —CON($R_{63}$)—$R_{61}$, —$SO_2$—$R_{62}$, and —$SO_2$N($R_{63}$)—$R_{61}$, or a hydrogen atom; $R_{55}$ represents a group selected from the group consisting of nitro, cyano, —CO—$R_{61}$, —$CO_2R_{62}$, —CON($R_{63}$)—$R_{61}$, —$SO_2$—$R_{62}$, and —$SO_2$N($R_{63}$)—$R_{61}$, or a hydrogen atom; $R_{56}$ represents the groups having the same meaning as $R_{54}$; and $R_{57}$ represents the groups having the same meaning as $R_{55}$.

In the above description, $R_{60}$ represents a hydrogen atom, an alkyl group (preferably a straight chain or branched alkyl group having from 1 to 32 carbon atoms, e.g., methyl, ethyl, propyl, isopropyl, butyl, t-butyl, 1-octyl, tridecyl), a cycloalkyl group (preferably a cycloalkyl group having from 3 to 8 carbon atoms, e.g., cyclopropyl, cyclo-pentyl, cyclohexyl, 1-norbornyl, 1-adamantyl), an alkenyl group (preferably an alkenyl group having from 2 to 32 carbon atoms, e.g., vinyl, allyl, 3-buten-1-yl), an aryl group (preferably an aryl group having from 6 to 32 carbon atoms, e.g., phenyl, 1-naphthyl, 2-naphthyl), a heterocyclic group (preferably a 5- to 8-membered heterocyclic group having rom 1 to 32 carbon atoms, e.g., 2-thienyl, 4-pyridyl, 2-furyl, 2-pyrimidinyl, 1-pyridyl, 2-benzothiazolyl, 1-imidazolyl, 1-pyrazolyl, benzotriazol-2-yl), an alkoxyl group (preferably an alkoxyl group having from 1 to 32 carbon atoms, e.g., methoxy, ethoxy, 1-butoxy, 2-butoxy, isopropoxy, t-butoxy, dodecyloxy), a cycloalkyloxy group (preferably a cycloalkyloxy group having from 3 to 8 carbon atoms, e.g., cyclopentyloxy, cyclohexyloxy), an aryloxy group (preferably an aryloxy group having from 6 to 32 carbon atoms, e.g., phenoxy, 2-naphthoxy), a heterocyclic oxy group (preferably a heterocyclic oxy group having from 1 to 32 carbon atoms, e.g., 1-phenyltetrazol-5-oxy, 2-tetrahydropyranyloxy, 2-furyloxy), a silyloxy group (preferably a silyloxy group having from 1 to 32 carbon atoms, e.g., trimethylsilyloxy, t-butyldimethylsilyloxy, diphenylmethylsilyloxy), an acyloxy group (preferably an acyloxy group having from 2 to 32 carbon atoms, e.g., acetoxy, pivaloyloxy, benzoyloxy, dodecanoyloxy), an amino group (preferably an amino group having 32 or less carbon atoms, e.g., amino, methylamino, N,N-dioctylamino, tetradecylamino, octadecylamino), an anilino group (preferably an anilino group having from 6 to 32 carbon atoms, e.g., anilino, N-methylanilino), a heterocyclic amino group (preferably a heterocyclic amino group having from 1 to 32 carbon atoms, e.g., 4-pyridylamino), an alkylthio group (preferably an alkylthio group having from 1 to 32 carbon atoms, e.g., ethylthio, octylthio), an arylthio group (preferably an arylthio group having from 6 to 32 carbon atoms, e.g., phenylthio), or a heterocyclic thio group (preferably a heterocyclic thio group having from 1 to 32 carbon atoms, e.g., 2-benzothiazolylthio, 2-pyridylthio, 1-phenyltetrazolylthio).

$R_{61}$ represents a hydrogen atom, an alkyl group, an aryl group or a heterocyclic group, and preferred carbon atom numbers and specific examples of these groups are the same as those in the alkyl, aryl and heterocyclic groups represented by $R_{60}$.

$R_{66}$ represents a hydrogen atom, a halogen atom, the groups having the same meaning as the groups represented by $R_{60}$, a cyano group, a silyl group (preferably a silyl group having from 3 to 32 carbon atoms, e.g., trimethylsilyl, triethylsilyl, tributylsilyl, t-butyldimethylsilyl, t-hexyldimethylsilyl), a hydroxyl group, a nitro group, an alkoxycarbonyloxy group (preferably an alkoxycarbonyloxy group having from 2 to 32 carbon atoms, e.g., ethoxycarbonyloxy, t-butoxycarbonyloxy), a cycloalkyloxycarbonyloxy group (preferably a cycloalkyloxycarbonyloxy group having from 4 to 9 carbon atoms, e.g., cyclohexyloxycarbonyloxy), an aryloxycarbonyloxy group (preferably an aryloxycarbonyloxy group having from 7 to 32 carbon atoms, e.g., phenoxycarbonyloxy), a carbamoyloxy group (preferably a carbamoyloxy group having from 1 to 32 carbon atoms, e.g., N,N-dimethylcarbamoyloxy, N-butylcarbamoyloxy), a sulfamoyloxy group (preferably a sulfamoyloxy group having from 1 to 32 carbon atoms, e.g., N,N-diethylsulfamoyloxy, N-propylsulfamoyloxy), an alkane-sulfonyloxy group (preferably an alkanesulfonyloxy group having from 1 to 32 carbon atoms, e.g., methanesulfonyloxy, hexadecanesulfonyloxy), an arenesulfonyloxy group (preferably an arenesulfonyloxy group having from 6 to 32 carbon atoms, e.g., benzenesulfonyloxy), an acyl group (preferably an acyl group having from 1 to 32 carbon atoms, e.g., formyl, acetyl, pivaloyl, benzoyl, tetradecanoyl), an alkoxycarbonyl group (preferably an alkoxycarbonyl group having from 2 to 32 carbon atoms, e.g., methoxycarbonyl, ethoxycarbonyl, octadecyloxycarbonyl), a cycloalkyloxycarbonyl group (preferably a cycloalkyloxycarbonyl group having from 2 to 32 carbon atoms, e.g., cyclohexyloxycarbonyl), an aryloxycarbonyl group (preferably an aryloxycarbonyl group having from 7 to 32 carbon atoms, e.g., phenoxycarbonyl), a carbamoyl group (preferably a carbamoyl group having from 1 to 32 carbon atoms, e.g., carbamoyl, N,N-dibutylcarbamoyl, N-ethyl-N-octylcarbamoyl, N-propylcarbamoyl), a carbonamido group (preferably a carbonamido group having from 2 to 32 carbon atoms, e.g., acetamido, benzamido, tetradecanamido), a ureido group (preferably a ureido group having from 1 to 32 carbon atoms, e.g., ureido, N,N-dimethylureido, N-phenylureido), an imido group (preferably an imido group having 10 or less carbon atoms, e.g., N-succinimido, N-phthalimido), an alkoxycarbonylamino group (preferably an alkoxycarbonylamino group having from 2 to 32 carbon atoms, e.g., methoxycarbonylamino, ethoxycarbonylamino, t-butoxycarbonylamino, octadecyloxycarbonylamino), an aryloxycarbonylamino group (preferably an aryloxycarbonylamino group having from 7 to 32 carbon atoms, e.g., phenoxycarbonylamino), a sulfonamido group (preferably a sulfonamido group having from 1 to 32 carbon atoms, e.g., methanesulfonamido, butanesulfonamido, benzenesulfonamido, hexadecanesulfonamido), a sulfamoylamino group (preferably a sulfamoylamino group having from 1 to 32 carbon atoms, e.g., N,N-dipropylsulfamoylamino, N-ethyl-N-dodecylsulfamoylamino), an alkylsulfinyl group (preferably an alkylsulfinyl group having from 1 to 32 carbon atoms, e.g., dodecanesulfinyl), an arenesulfinyl group (preferably an arenesulfinyl group having from 6 to 32 carbon atoms, e.g., benzenesulfinyl), an alkanesulfonyl group (preferably an alkanesulfonyl group having from 1 to 32 carbon atoms, e.g., methanesulfonyl, octanesulfonyl), an arenesulfonyl group (preferably an arenesulfonyl group having from 6 to 32 carbon atoms, e.g., benzenesulfonyl, 1-naphthalenesulfonyl), a sulfamoyl group (preferably a sulfamoyl group having 32 or less carbon atoms, e.g., sulfamoyl, N,N-dipropylsulfamoyl, N-ethyl-N-dodecylsulfamoyl), a sulfo group, or a phosphonyl group (preferably a phosphonyl group having from 1 to 32 carbon atoms, e.g., phenoxyphosphonyl, octyloxyphosphonyl, phenylphosphonyl).

$R_{63}$ represents a hydrogen atom, an alkyl group, an aryl group, an acyl group, an alkanesulfonyl group or an arenesulfonyl group, and $R_{62}$ represents an alkyl group, an aryl group, or a heterocyclic group, and carbon atom numbers and specific examples of these groups are the same as those described in the groups represented by $R_{60}$ and $R_{66}$.

When $R_{60}$, $R_{61}$, $R_{62}$, $R_{63}$ and $R_{66}$ represent groups which can have further substituents, examples of preferred substituents include a halogen atom, an alkyl group, a cycloalkyl group, an alkenyl group, an aryl group, a heterocyclic group, a cyano group, a silyl group, a hydroxyl group, a carboxyl group, a nitro group, an alkoxyl group, an aryloxy group, a heterocyclic oxy group, a silyloxy group, an acyloxy group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, an amino group, an anilino group, a heterocyclic amino group, a carbonamido group, an alkoxycarbonylamino group, an aryloxycarbonylamino group, a ureido group, a sulfonamido group, a sulfamoylamino group, an imido group, an alkylthio group, an arylthio group, a heterocyclic thio group, a sulfinyl group, a sulfo group, an alkanesulfonyl group, an arenesulfonyl group, a sulfamoyl group, and a phosphonyl group, and carbon a tom numbers and specific examples of these groups are the same as those described in the groups represented by $R_{60}$, and $R_{66}$.

The use of blocking groups of this type is described more fully in U.S. Pat. No. 5,830,627, the entire disclosures of which are incorporated herein by reference.

In another embodiment of the invention, the B—ETA is of the formula:

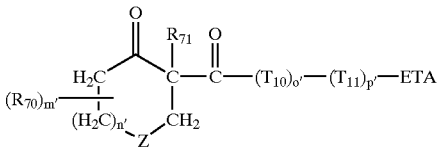

wherein $T_{10}$ and $T_{11}$ individually are releasable timing groups;

o' and p' individually are 0 or 1, at least one of o' and p' being 1;

n' is 0, 1 or 2;

m' is 0, 1, 2, or 3;

$R_{70}$ us substituted or unsubstituted alkyl or aryl or a photographic ballast group replacing a ring hydrogen;

$R_{71}$ is substituted or unsubstituted alkyl;

Z is located at any ring position not adjacent to the ketocarbonyl group and is a group having one of the formulae:

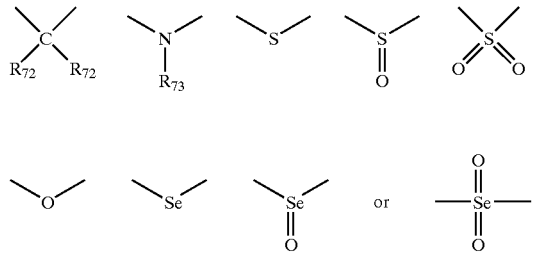

wherein each $R_{72}$ is individually a substituted or unsubstituted alkyl, aryl or heterocyclic group, or a carbamoyl carbonamido, sulfamoyl, sulfonamido, ester or acid group;

R73 is

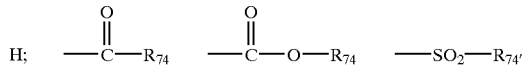

substituted or unsubstituted alkyl or aryl or a photographic ballast group;

$R_{74}$ is substituted or unsubstituted alkyl or aryl;

$R_{74'}$ is substituted or unsubstituted alkyl or aryl, or —$N(R_{75})(R_{76})$ where $R_{75}$ and $R_{76}$ individually are hydrogen, or substituted or unsubstituted alkyl or aryl.

Illustrative B—ETA compounds are of the formula:

B-ETA 1

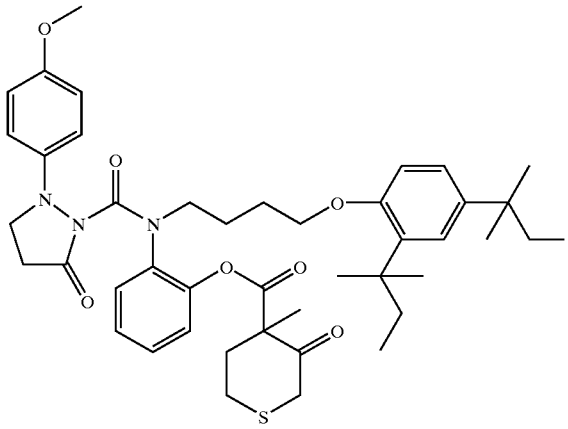

-continued

B-ETA 2

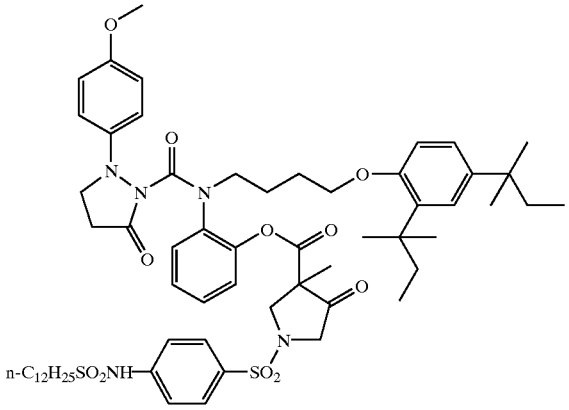

B-ETA 3

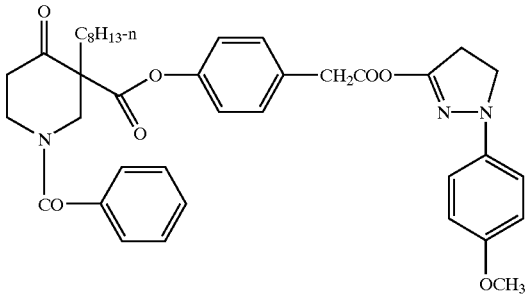

B-ETA 4

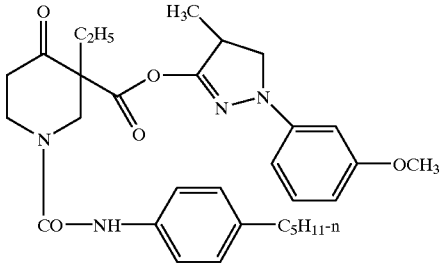

B-ETA 5

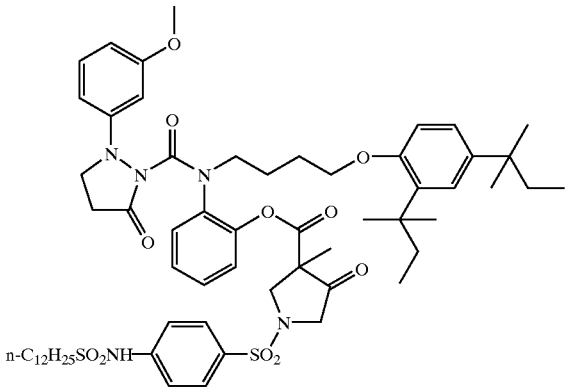

-continued

B-ETA 6

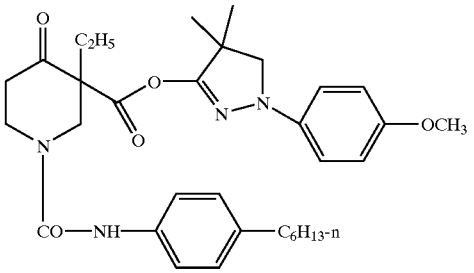

B-ETA 7

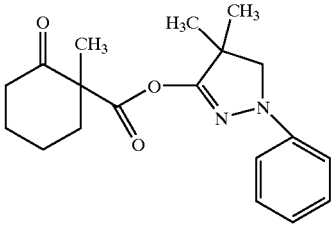

B-ETA 8

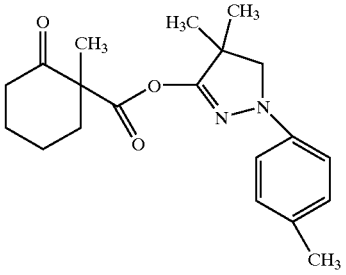

B-ETA 9

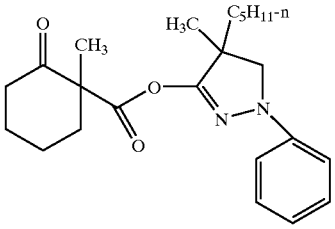

B-ETA 10

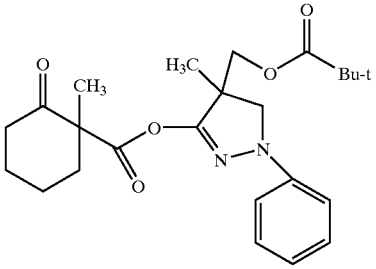

These blocked B—ETA compounds are described more fully in published European patent application No. 0 679 943, the disclosures of which are incorporated herein by reference.

The amount of compound capable of release of electron transfer agent which can be employed with this invention can be any concentration which is effective for the intended purpose. Good results have been obtained when the compound is employed at a concentration of from about 0.2 to about 1.8 mmols/$m^2$ of photographic recording material. A preferred concentration is from about 0.5 to about 1.5 mmols/$m^2$.

Although the ETARC can itself form an image dye on coupling, in most instances the concentrations of the ETARC are less than those capable of providing a desired level of dye density in the absence of another image dye source. It is therefore contemplated to incorporate in the dye image forming layer unit a conventional image dye forming coupler in addition to the ETARC. The image dye forming coupler typically forms a cyan, magenta or yellow dye on coupling and can take the form of any of the conventional cyan, magenta or yellow image dye forming couplers disclosed in the patents cited above to show suitable COUP moieties for ETARC addenda that form a cyan, magenta or yellow image dye on coupling. These and additional forms of conventional image dye forming couplers are summarized in *Research Disclosure*, Item 38957, X. Dye image formers and modifiers, B. Image-dye-forming couplers. Additionally, other conventional dye image modifiers, such as those summarized in Item 38957, X., C. Image dye modifiers, although not required, can be employed, if desired, in combination with the ETARC couplers.

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. Nos. 4,279,945 and 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support).

The present invention also contemplates the use of photographic elements of the present invention in what are often referred to as single use cameras (or "film with lens" units). Single use cameras are well known and typically comprise (1) a plastic inner camera shell including a taking lens, a film metering mechanism, and a simple shutter and (2) a paper-cardboard outer sealed pack which contains the inner camera shell and has respective openings for the taking lens and for a shutter release button, a frame counter window, and a film advance thumbwheel on the camera shell. The camera may also have a flash unit to provide light when the picture is taken. The inner camera shell has front and rear viewfinder windows located at opposite ends of a see-through viewfinder tunnel, and the outer sealed pack has front and rear openings for the respective viewfinder windows. At the manufacturer, the inner camera shell is loaded with a film cartridge, and substantially the entire length of the unexposed filmstrip is factory prewound from the cartridge into a supply chamber of the camera shell. After the customer takes a picture, the thumbwheel is manually rotated to rewind the exposed frame into the cartridge. The rewinding movement of the filmstrip the equivalent of one frame rotates a metering sprocket to decrement a frame counter to its next lower numbered setting. When substantially the entire length of the filmstrip is exposed and rewound into the cartridge, the single-use camera is sent to a photofinisher who first removes the inner camera shell from the outer sealed pack and then removes the filmstrip from the camera shell. The filmstrip is processed, and the camera shell and the opened pack are thrown away, or preferably, recycled.

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. Nos. 4,279,945 and 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

In the following discussion of suitable materials for use in elements of this invention, reference will be made to *Research Disclosure*, Vol. 389, September 1996, Item 38957, (herein referred to as "Research Disclosure I") published by Kenneth Mason Publications, Ltd., Dudley House, 12 North St., Emsworth, Hampshire P010 7DQ, England.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. In particular image dye-forming couplers are described in Section X, paragraph B. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); development inhibitors and their precursors (U.S. Pat. Nos. 5,460,932; 5,478,711); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. Nos. 4,420,556; and 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. No. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. As discussed above, for these epitaxially sensitized emulsions, sensitizing dye is preferably present before the formation of the epitaxy. The dye/silver halide emulsion may be mixed with a dispersion of color image-forming coupler immediately before coating or in advance of coating (for example, 2 hours).

Preferred sensitizing dyes that can be used are cyanine, merocyanine, styryl, hemicyanine, or complex cyanine dyes. Illustrative dyes that can be used include those dyes disclosed in U.S. Pat. Nos. 5,747,235 and 5,747,236, the entire disclosures of which are incorporated herein by reference.

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process,* 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying.

The invention can be better appreciated by reference to the following specific embodiments.

EXAMPLE 1

Emulsion T-1

To a solution of 10 g low methionine bone gelatin (methionine content <3 micromole per g gelatin), in 7.0 L distilled water was added 46 mmole of NaBr at 40° C., pH 5.0. To a vigorously stirred reaction vessel of this gelatin solution at 40° C., maintained at pH 5.0 throughout the precipitation, a 2.5 M $AgNO_3$ solution was added at 200 mL per min for 21 sec. Concurrently, a salt solution of 2.5 M NaBr was added initially at 200 mL per min and then at a rate needed to maintain a pBr of 2.11. Then the addition of the solutions was stopped, 82 mL of the salt solution was added in 1 min and the temperature of the contents of the reaction vessel was increased to 60° C. at a rate of 1.67° C. per min. Then all but 1.750 kg of the seed emulsion (0.042 mole Ag) was discarded. After the seed emulsion was at 60° C. for a total of 22 min, a solution preheated to 60° C. containing 100 g of oxidized bone gelatin, 1L distilled water, and 15.3 mL of 2 M NaBr was added. Then at 60° C., the $AgNO_3$ solution was added at 1.0 mL per min for 1 min then accelerated to 25 mL per min in 150 min and held at this flow rate until a total of 2,453 mL of the $AgNO_3$ solution was used. The salt solution was concurrently added until 240 mL of the $AgNO_3$ solution had been added, then a new salt solution of 2.5 M NaBr, and 0.04 M KI was used to maintain a pBr of 1.44 throughout the rest of the precipitation. The total making time of the emulsion was 194 min. The emulsion was cooled to 40° C. and ultrafiltered to a pBr of 3.26. Then 12.4 g per mole silver of bone gelatin (methionine content ~55 micromole per g gelatin) was added.

The resulting {111} tabular grains had an average equivalent circular diameter of 3.8 μm, an average thickness of 0.07 μm, and an average aspect ratio of 54. The tabular grain population made up 99% of the total projected area of the emulsion grains.

Epitaxy

Epitaxy was deposited on Emulsion T-1 by the following procedure: A vigorously stirred 1.0 mole aliquot of the emulsion was adjusted to a pAg of 7.59 at 40° C. by the addition of 0.25 M AgNO3 solution. Then 5 mL of a 1 M KI solution was added followed by 11 mL of a 3.77 M NaCl solution. Then the blue spectral sensitizing dye, anhydro-5, 5'-dichloro-3,3'-bis(3-sulfopropyl)thiacyanine hydroxide, triethylammonium salt, was added in the form of a gelatin-dye dispersion in an amount of 80% of the saturation coverage of the grains' surfaces. After stirring for 25 min, 84 mL of a 0.25 M NaCl solution and 84 mL of a 0.25 M NaBr solution were added followed by 8 mmole of an AgI fine grain (~0.05 μm) emulsion. To this mixture with vigorous stirring was added 0.5 M $AgNO_3$ at 76 mL per min for 1.1 min.

Electron microscopy analysis of the resulting emulsions showed the tabular grains had epitaxial deposits located primarily at the tabular grain corners and edges. As formulated these deposits had a nominal halide composition of 42 M % chloride, 42 M % bromide, and 16 M % iodide, based on silver.

Chemical Sensitization

The emulsion T-1 with corner epitaxy was chemically sensitized by adding with stirring at 40° C. solutions of (amount per mole silver) NaSCN (0.925 mmole), 1,3-dicarboxymethyl-1,3-dimethyl-2-thiourea, (the optimized level for each emulsion was found to be the same, 7.8 micromole), bis(1,4,5-trimethyl-1,2,4-triazolium-3-thiolate) gold(I) tetrafluoroborate (1.5 micromole), 3-{3-[(methylsulfonyl)amino]-3-oxopropyl} benzothiazolium tetrafluoroborate (81 micromole). The emulsion was then heated at 50° C. for 10 minutes, cooled to 40° C., then sequentially 1-(3-acetamidophenyl)-5-mercaptotetrazole (0.489 mmole), FED 2 (2.8 micromole), and 4-hydroxy-6-methyl-1,3,3a,7-tetraazaindene (10 mmole) were added.

Performance

The sensitized emulsion T-1 was coated on clear acetate support having an antihalation layer on the opposite side. The coatings lacking an ETARC coupler were prepared as follows: The emulsion coated layer contained 0.81 $g/m^2$ silver, 0.324 $g/m^2$ cyan dye-forming coupler, 4.32 $g/m^2$ gelatin and surfactant. A solution of gelatin and bis (vinylsulfonylmethyl)ether were overcoated at 0.9 $g/m^2$ gelatin and 72 $mg/m^2$ hardener, respectively.

The coatings containing an ETARC coupler were prepared as follows: The emulsion coated layer contained 0.81 $g/m^2$ silver, 0.27 $g/m^2$ cyan dye-forming coupler, 0.16 $g/m^2$ ETARC coupler E-25, 4.32 $g/m^2$ gelatin and surfactant. A solution of gelatin and bis(vinylsulfonylmethyl)ether were overcoated at 0.9 $g/m^2$ gelatin and 72 $mg/m^2$ hardener, respectively. Each of the film coatings were exposed for 0.01 sec to a 5500 K color temperature tungsten light source filtered through a Kodak Wratten™ 2B filter and a 0 to 4 density step tablet. The exposed film coatings were processed using the Kodak Flexicolor™ C-41 color negative film process.

Minimum density ($D_{min}$), Gamma and Speed are compared in Table I below. Speed is reported as 100* (relative log sensitivity), where sensitivity is equal to 1/E and E represents exposure in lux-seconds required to reach the speed measurement point. Speed was measured on the characteristic curve at the intersection of the extrapolated straight line portion of the characteristic curve with the straight line extrapolation of the $D_{min}$ segment of the characteristic curve. Gamma is the slope of the straight line portion of the characteristic curve.

TABLE I

Effect of FED and ETARC in an Epitaxially Sensitized Tabular Grain Emulsion

| FEDS | ETARC | $D_{min}$ | Gamma | Adjusted Speed |
|---|---|---|---|---|
| No | No | 0.04 | 0.79 | 100 |
| No | Yes | 0.04 | 0.89 | 121 |
| Yes | No | 0.06 | 0.77 | 128 |
| Yes | Yes | 0.14 | 0.68 | 154 |

The effect of the ETARC in the absence of the FED is to enhance the speed of the emulsion by 0.21 log E (121-100=a 62% improvement), while the effect of the ETARC in the presence of the FED is 0.26 log E (154-128=an 82% improvement). Clearly, the effect of the ETARC is enhanced in the presence of the FED.

In a similar vein, the effect of the FED in the absence of the ETARC is a speed improvement of 0.28 log E (128-100=a 91% improvement) while in the ETARC s presence the FED gives 0.33 log E (114% improvement). Again, the situation is such that the effect of the FED is enhanced in the ETARC s presence.

EXAMPLE 2

Emulsion and Chemical Sensitization

An AgBrI tabular silver halide emulsion (Emulsion T-2) was prepared containing 4.05% total I distributed such that the central portion of the emulsion grains contained 1.5% I and the perimeter area contained substantially higher I as described by Chang et. al., U.S. Pat. No. 5,314,793. The emulsion grains had an average thickness of 0.103 $\mu$m and average circular diameter of 1.25 $\mu$m. Emulsion T-2 was precipitated using deionized gelatin. The emulsion T-2 was optimally chemically and spectrally sensitized by adding NaSCN, $1.07\times10^{-3}$ mole/mole Ag of the blue sensitizing dye D-I, $Na_3Au(S_2O_3)_2.2H_2O$, $Na_2S_2O_3.5H_2O$, and a benzothiazolium finish modifier and then subjecting the emulsion to a heat cycle to 65° C. After the chemical sensitization procedure, the antifoggant and metal sequesterant, 2,4-disulfocatechcol (HB3) at a concentration of $13\times10^{-3}$ mole/mole Ag was added, followed by the antifoggant and stabilizer tetraazaindene at a concentration of 1.75 gm/mole Ag. As detailed in Table II below, for some experimental variations, the FED sensitizer, FED 1, was then added at a concentration of $4.5\times10^{-5}$ mole/mole Ag.

Performance

The sensitized emulsion T-2 was coated on clear acetate support having an antihalation layer on the opposite side. The coatings lacking an ETARC coupler were prepared as follows: The emulsion coated layer contained 0.81 g/m$^2$ silver, 0.324 g/m$^2$ cyan dye-forming coupler, 3.23 g/m$^2$ gelatin and surfactant. A solution of gelatin and bis (vinylsulfonyl)methane were overcoated at 2.7 g/m$^2$ gelatin and 108 mg/m$^2$ hardener, respectively.

The coatings containing an ETARC coupler were prepared as follows: The emulsion coated layer contained 0.81 g/m$^2$ silver, 0.27 g/m$^2$ cyan dye-forming coupler, 0.16 g/m$^2$ ETARC coupler E-25, 3.23 g/m$^2$ gelatin and surfactant. A solution of gelatin and bis(vinylsulfonyl)methane were overcoated at 2.7 g/m$^2$ gelatin and 108 mg/m$^2$ hardener, respectively. Each of the film coatings were exposed and processed as described in Example 1. Minimum density ($D_{min}$), Gamma and Speed are compared in Table II below.

TABLE II

Effect of FED and ETARC in a Tabular Grain Emulsion Sensitized without Epitaxy

| FEDS | ETARC | $D_{min}$ | Gamma | Adjusted Speed |
|---|---|---|---|---|
| No | No | 0.06 | 1.17 | 100 |
| No | Yes | 0.07 | 0.98 | 115 |
| Yes | No | 0.12 | 0.99 | 130 |
| Yes | Yes | 0.16 | 0.73 | 148 |

The effect of the ETARC in the absence of the FED is to enhance the speed of the emulsion by 0.15 log E (a 41% improvement), while the effect of the ETARC in the presence of the FED is 0.18 log E (a 51% improvement). These data show that the effect of the ETARC is enhanced in the presence of the FED.

In a similar vein, the effect of the FED in the absence of the ETARC is a speed improvement of 0.30 log E (a 100% improvement) while in the ETARC's presence the FED gives 0.33 log E (114% improvement). Again, the data indicate that the effect of the FED is enhanced by the ETARC's presence.

The invention has been described in detail with particular reference to certain preferred embodiments thereof, but it will be understood that variations and modifications can be effected within the spirit and scope of the invention.

What is claimed is:

1. A color photographic element comprising a support and at least one dye image forming layer unit comprising gelatin-peptized radiation-sensitive silver halide grains, a fragmentable electron donating compound; and an electron transfer agent releasing compound, wherein the fragmentable electron donating sensitizer is of the formula X—Y' or a compound which contains a moiety of the formula —X—Y';

wherein

X is an electron donor moiety, Y' is a leaving proton H or a leaving group Y, with the proviso that if Y' is a proton, a base, $\beta^-$, is covalently linked directly or indirectly to X, and wherein:

1) X—Y' has an oxidation potential between 0 and about 1.4 V; and 2) the oxidized form of X—Y' undergoes a bond cleavage reaction to give the radical $X^{\bullet}$ and the leaving fragment Y'; and 3) the radical $X^{\bullet}$ has an oxidation potential <−0.7V (that is, equal to or more negative than about −0.7V); and wherein the electron transfer agent is of the formula:

$$CAR—(L')_n—ETA$$

wherein:

CAR is a carrier moiety which is capable of releasing —(L')$_n$—ETA on reaction with oxidized developing agent;

n is 0, 1, or 2;

L' represents a divalent linking group which may be of the same or different type when more than one L' moiety is present; and ETA is a 1-aryl-3-pyrazolidinone derivative.

2. A photographic element according to claim 1, wherein X is of structure (I):

(I)

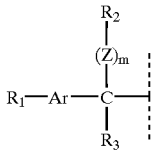

$R_1$ represents R, carboxyl, amide, sulfonamide, halogen, $NR_2$, $(OH)_n$, $(OR')_n$, or $(SR)_n$;

R' represents an alkyl or substituted alkyl group;

n represents 1, 2 or 3;

$R_2$ represents R, or Ar', $R_3$ represents R, or Ar', $R_2$ and $R_3$ together can form a 5- to 8-membered ring wherein:

m represents 0, or 1;

Z represents O, S, Se, or Te;

$R_2$ and Ar can be linked to form a 5- to 8-membered ring;

$R_3$ and Ar can be linked to form a 5- to 8-membered ring;

Ar' represents an aryl group or heterocyclic group; and

R represents a hydrogen atom or an unsubstituted or substituted alkyl group.

3. A photographic element according to claim 2, wherein the compound of Structure (I) is selected from:

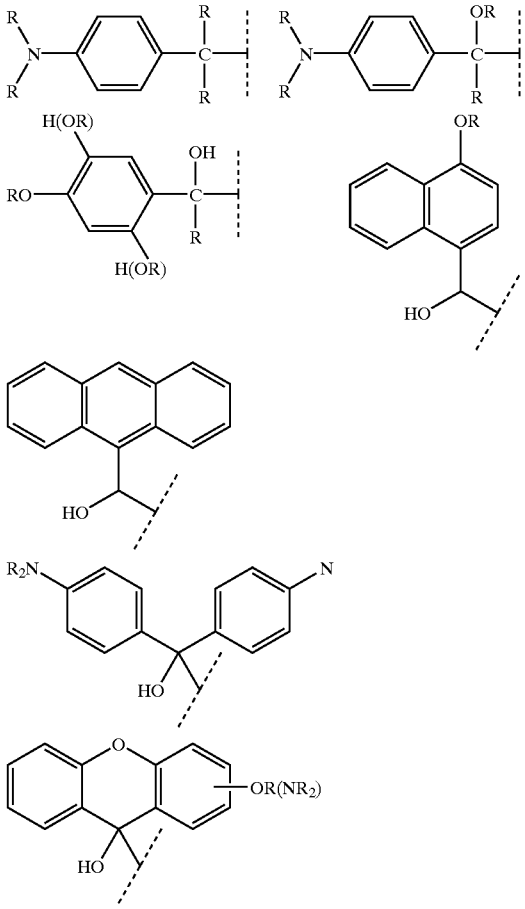

-continued

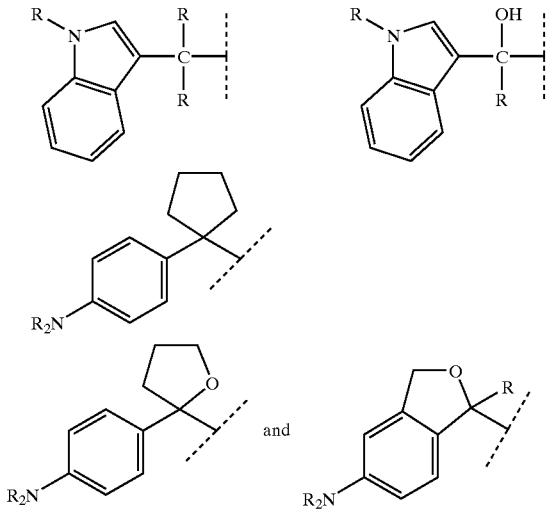

wherein each R is independently a hydrogen atom or a substituted or unsubstituted alkyl group.

4. A photographic element according to claim 1, wherein X is a compound of structure (II):

(II)

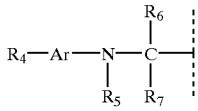

wherein:

Ar represents an aryl group or heterocyclic group $R_4$ represents a substituent having a Hammett sigma value of −1 to +1, $R_5$ represents R or Ar'

$R_6$ and $R_7$ represents R or Ar'

$R_5$ and Ar can be linked to form a 5- to 8-membered ring;

$R_6$ and Ar can be linked to form a 5- to 8-membered ring (in which case, $R_6$ can be a hetero atom);

$R_5$ and $R_6$ can be linked to form a 5- to 8-membered ring;

$R_6$ and $R_7$ can be linked to form a 5- to 8-membered ring;

Ar' represents an aryl group or heterocyclic group; and

R represents a hydrogen atom or an unsubstituted or substituted alkyl group.

5. A photographic element according to claim 4, wherein X is selected from:

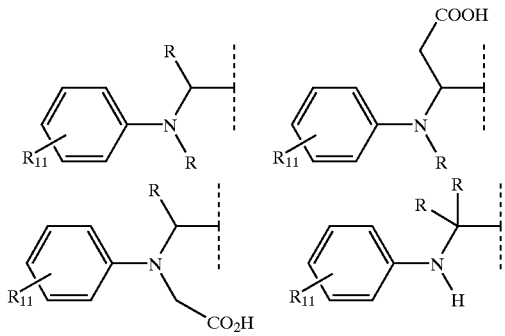

-continued

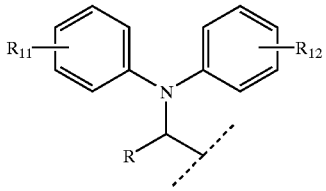

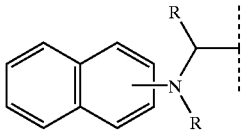

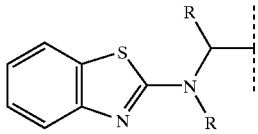

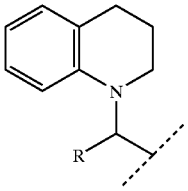

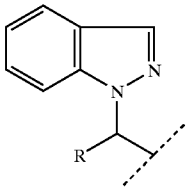

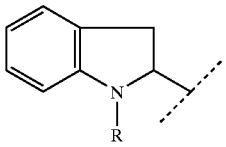

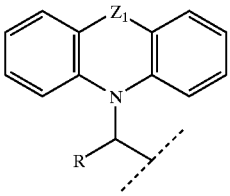

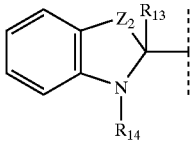

$R_{11}$ and $R_{12}$ = { H, alkyl, alkoxy, alkylthio, halo, carbamoyl, carboxyl, amido, formyl, sulfonyl, sulfonamido, or nitrile }

$Z_1$=a covalent bond, S, O, Se, NR, $CR_2$, CR═CR, or $CH_2CH_2$;

$Z_2$=S, O, Se, NR, $CR_2$, or CR═CR, $R_{13}$,=alkyl, substituted alkyl or aryl; and $R_{14}$=H, alkyl substituted alkyl or aryl.

6. A photographic element according to claim 1, wherein X is a compound of structure (III):

(III)

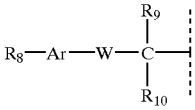

wherein:

W represents O, S, or Se;

Ar represents an aryl group or heterocyclic group;

$R_8$ represents R, carboxyl, $NR_2$, $(OR)_n$, or $(SR)_n$(n=1–3);

$R_9$ and $R_{10}$ represents R, or Ar';

$R_9$ and Ar can be linked to form a 5- to 8-membered ring;

Ar' represents an aryl group or heterocyclic group; and

R represents a hydrogen atom or an unsubstituted or substituted alkyl group.

7. A photographic element according to claim 6, wherein X is selected from:

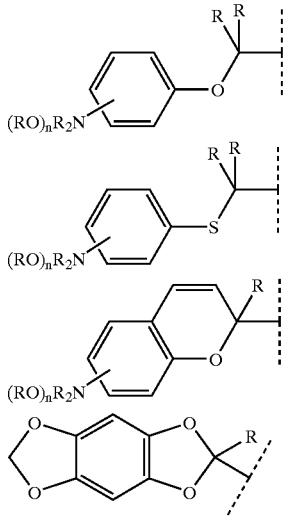

and wherein n=1–3.

8. A photographic element according to claim 1, wherein X is of structure (IV):

(IV)

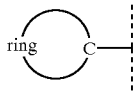

wherein:

"ring" represents a substituted or unsubstituted 5-, 6-, or 7-membered unsaturated ring.

9. A photographic element according to claim 8, wherein X is selected from:

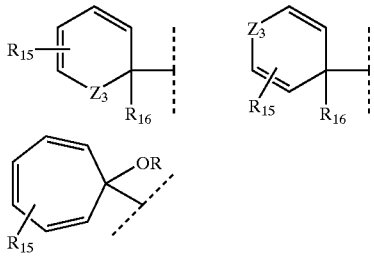

wherein $Z_3$=O, S, Se, or NR $R_{15}$ represents R, OR, or $NR_2$ $R_{16}$ represents an alkyl, or substituted alkyl, and R is a hydrogen atom or an unsubstituted or substituted alkyl group.

10. A photographic element according to claim 1, wherein Y' is:

(1) X', where X' is an X group as defined in structures I–IV and may be the same as or different from the X group to which it is attached (2) —$coo^-$ (3) ┤—$M(R')_3$ where M=Si, Sn or Ge; and R'=alkyl or substituted alkyl (4) —$B^-(Ar'')_3$ where Ar''=aryl or substituted aryl (5) —H.

11. A photographic element according to claim 1, wherein the fragmentable electron donor compound is selected from compounds of the formulae:

$Z—(L—X—Y')_k$ $A—(L—X—Y')_k$ $(A—L)_k—X—Y'$ $Q—X—Y'$ $A—(X—Y')_k$ $(A)_k—X—Y'$ $Z—(X—Y')_k$ or $(Z)_k—X—Y'$ wherein:

Z is a light absorbing group;

k is 1 or 2;

A is a silver halide adsorptive group;

L represents a linking group containing at least one C, N, S, P or O atom; and

Q represents the atoms necessary to form a chromophore comprising an amidinium-ion, a carboxyl-ion or dipolar-amidic chromophoric system when conjugated with X—Y'.

12. A photographic element according to claim 11, wherein the fragmentable electron donor compound is of the formula:

$Z—(L—X—Y')_k$ $Z—(X—Y')_k$ or $(Z)_k—X—Y'$ wherein Z is derived from a cyanine dye, complex cyanine dye, merocyanine dye, complex merocyanine dye, homopolar cyanine dye, styryl dye, oxonol dye, hemioxonol dye, or hemicyanine dye.

13. A photographic element according to claim 11, wherein the fragmentable electron donor compound is of the formula:

$A—(L—X—Y')_k$ $(A—L)_k—X—Y'$ $A—(X—Y')_k$ or $(A)_k—X—Y'$ wherein: A is a silver-ion ligand moiety or a cationic surfactant moiety.

14. A photographic element according to claim 13, wherein A is selected from the group consisting of: i) sulfur acids and their Se and Te analogs, ii) nitrogen acids, iii) thioethers and their Se and Te analogs, iv) phosphines, v) thionamides, selenamides, and telluramides, and vi) carbon acids.

15. A photographic element according to claim 11, wherein the fragmentable electron donor compound is of the formula:

$Q—X—Y'$ wherein Q represents a chromophoric system comprising a cyanine, complex cyanine, hemicyanine, merocyanine, or complex merocyanine dye.

16. A photographic element according to claim 1, wherein the fragmentable electron donor compound is a compound of the formula:

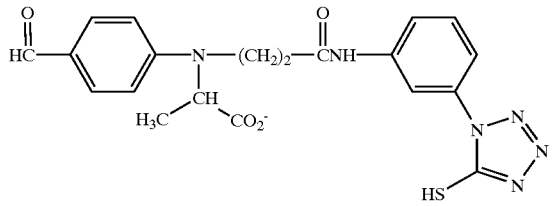

17. A photographic element according to claim 1, wherein ETA is a 1-aryl-3-pyrazolidinone of the formula I' or II':

(I')

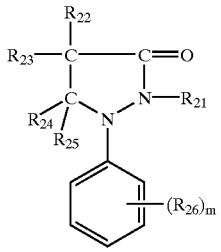

(II')

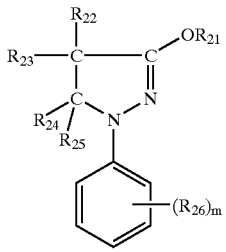

wherein:

$R_{21}$ is hydrogen; $R_{22}$ and $R_{23}$ each independently represents hydrogen, substituted or unsubstituted alkyl having from 1 to about 12 carbon atoms, $CH_2OR'$ or $CH_2OC(O)R'$ where R' can be a substituted or unsubstituted alkyl, aryl or a heteroatom containing group, carbamoyl, or substituted or unsubstituted aryl having from 6 to about 10 carbon atoms, $R_{24}$ and $R_{25}$ each independently represents hydrogen, substituted or unsubstituted alkyl having from 1 to about 8 carbon atoms or substituted or unsubstituted aryl having from 6 to about 10 carbon atoms;

$R_{26}$, which may be present in the ortho, meta or para positions of the benzene ring, represents halogen, substituted or unsubstituted alkyl having from 1 to about 8 carbon atoms, or substituted or unsubstituted alkoxy having from 1 to about 8 carbon atoms, or sulfonamido, and when m is greater than 1, the $R_{26}$ substituents can be the same or different or can be taken together to form a carbocyclic or a heterocyclic ring, for example a benzene or an alkylenedioxy ring; and m is 0 or 1 to 3.

18. A photographic element according to claim 1, wherein the linking group (L')— is of the formula:

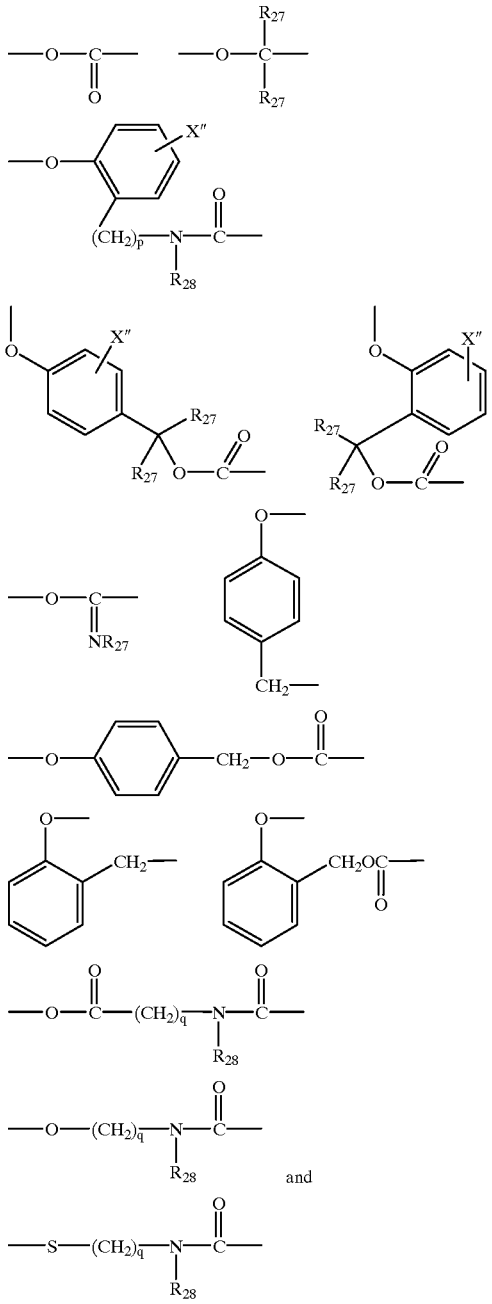

wherein each $R_{27}$ can independently be hydrogen, alkyl; $R_{28}$ is alkyl or aryl;

X" is —$NO_2$, —CN, sulfone, halogen or alkoxycarbonyl;

and p is 0 or 1 and q is from 1 to 4.

19. A photographic element according to claim 1, wherein CAR is a coupler which forms a cyan dye on reaction with oxidized color developing agent and has formula:

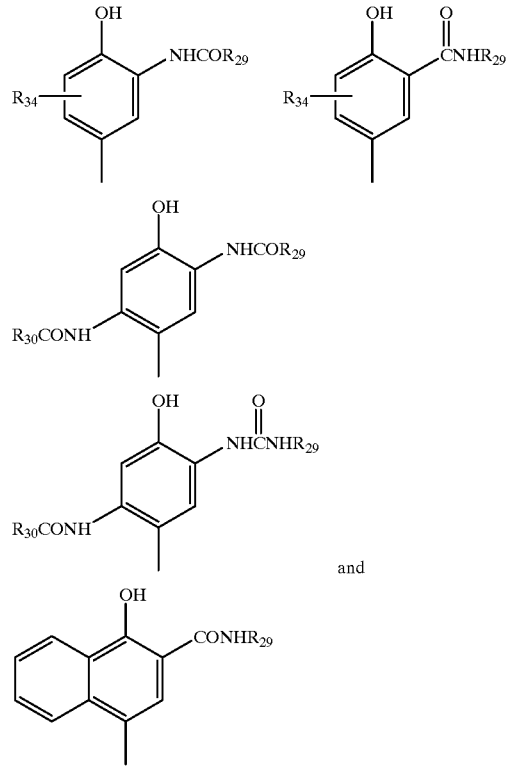

where each of $R_{29}$ and $R_{30}$ represents a ballast group or a substituted or unsubstituted alkyl or aryl group, and $R_{34}$ represents one or more halogen or an alkyl group.

20. A photographic element according to claim 1, wherein CAR is a coupler which forms a cyan dye on reaction with oxidized color developing agent and has formula

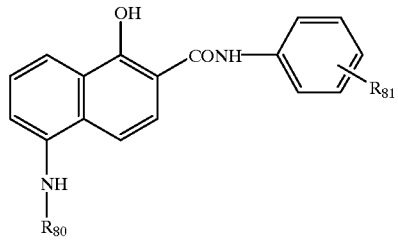

wherein $R_{81}$ is a ballast group and $R_{80}$ is $SO_2NHR_{82}$ OR $C(O)R_{82}$, where $R_{82}$ is an alkyl group.

21. A photographic element according to claim 1, wherein CAR is a coupler which forms a magenta dye on reaction with oxidized color developing agent and has the formula:

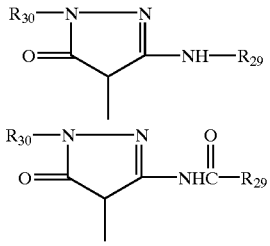

-continued

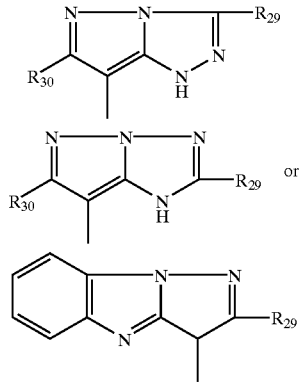

wherein each of $R_{29}$ and $R_{30}$ represent a ballast group or a substituted or unsubstituted alkyl or aryl group.

22. A photographic element according to claim 1, wherein CAR is a coupler which forms a yellow dye on reaction with oxidized color developing agent and has the formula:

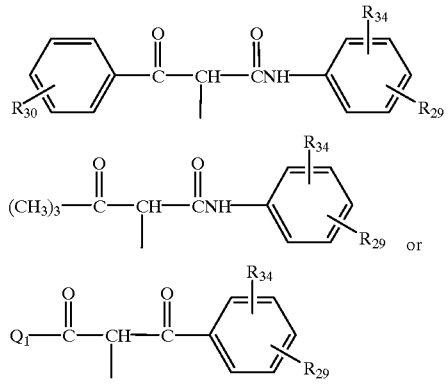

wherein $R_{29}$ and $R_{30}$ are each independently a ballast group or a substituted or unsubstituted alkyl or aryl group, hydrogen, alkoxy, alkoxycarbonyl, alkanesulfonyl, arenesulfonyl, aryloxycarbonyl, carbonamido, carbamoyl, sulfonamido, or sulfamoyl, $R_{34}$ is hydrogen, halogen, lower alkyl, lower alkoxy, or a ballast group and $Q_1$ is an alicyclic or heterocyclic group.

23. A photographic element according to claim 1, wherein CAR is a coupler which forms a yellow dye on reaction with oxidized color developing agent and has the formula:

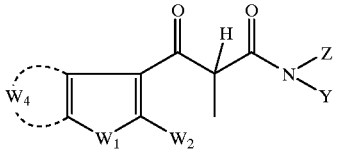

-continued

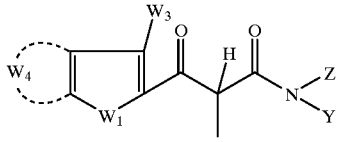

wherein:

$W_1$ is a heteroatom or heterogroup;

$W_2$ is H, or a substituent group;

$W_3$ is H, or a substituent group;

$W_4$ represents the atoms necessary to form a fused ring with the ring containing $W_1$;

Y and Z are independently H or a substituent group.

24. A photographic element according to claim 1, wherein CAR is a coupler which forms a yellow dye on reaction with oxidized color developing agent and has the formula:

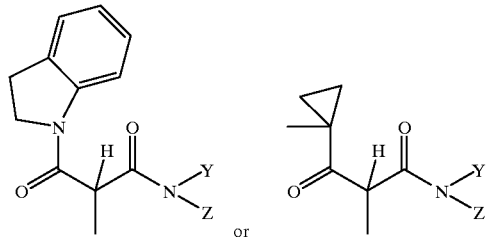

wherein Y and Z are independently H or a substituent group.

25. A photographic element according to claim 1, wherein CAR is of the formula:

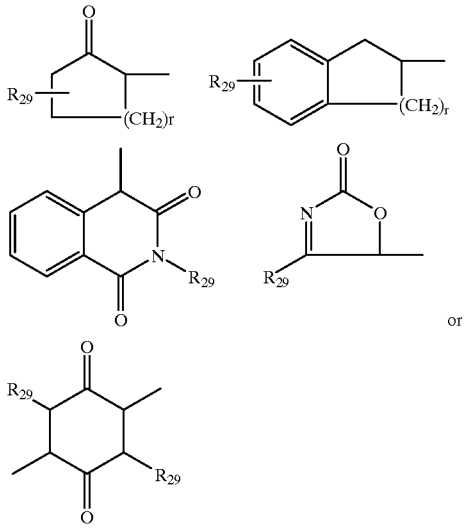

where $R_{29}$ represents a ballast group or a substituted or unsubstituted alkyl or aryl group and r is 1 or 2.

26. A photographic element according to claim 1 wherein CAR is a blocking group.

27. A photographic element according to claim 26, wherein the electron transfer agent releasing compound is of the formula:

$$[E_3—(Y_1)_w—E_4—(T_1)_x—(T_2)_y]_n—ETA$$

wherein $E_3$ and $E_4$ are independently electrophilic groups, wherein $E_3$ is more electrophilic than $E_4$;

$T_1$ and $T_2$ are individually releasable timing groups;

$Y_1$ is unsubstituted or substituted atom, preferably a car bon or nitrogen atom, that provides a distance between $E_3$ and $E_4$ that enables a nucleophilic displacement reaction to occur with release of ETA upon processing a photographic element containing the blocked photo ETA in the presence of a dinucleophile;

ETA is an electron transfer agent;

w, x and y are independently 0 or 1; and n' is 1 or 2.

28. A photographic element according to claim 26, wherein the electron transfer agent releasing compound is of the formula:

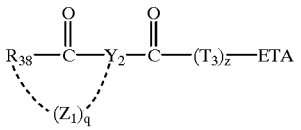

wherein $R_{38}$ is unsubstituted or substituted alkyl, unsubstituted or substituted aryl, or the atoms necessary with $Z_1$ to complete a ring, particularly an alicyclic or heterocyclic ring, with $Y_2$;

$Z_1$ represents the atoms necessary to complete a ring with $R_{38}$ and $Y_2$;

$Y_2$ is a substituted or unsubstituted carbon or nitrogen atom that provides a distance between the carbonyl groups that enables a nucleophilic displacement reaction to occur upon processing a photographic element containing the blocked ETA in the presence of a dinucleophile;

q and z are independently 0 or 1;

$T_3$ is a releasable timing group; and

ETA is an electron transfer agent.

29. A photographic element according to claim 26, wherein the electron releasing compound is of the formula:

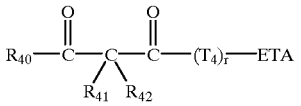

and

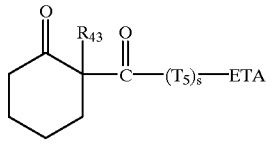

wherein $R_{40}$, $R_{41}$, $R_{42}$ and $R_{43}$ individually are unsubstituted or substituted alkyl or unsubstituted or substituted aryl;

ETA is an electron transfer agent;

$T_4$ and $T_5$ are individually releasable timing groups; and r and s individually are 0 or 1.

30. A photographic element according to claim 26, wherein the electron transfer agent releasing compound is of the formula:

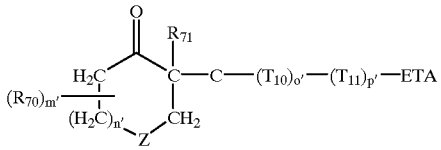

wherein $T_{10}$ and $T_{11}$ individually are releasable timing groups;

o' and p' individually are 0 or 1, at least one of o' and p' being 1;

n' is 0, 1 or 2;

m' is 0, 1, 2, or 3;

$R_{70}$ is substituted or unsubstituted alkyl or aryl or a photographic ballast group replacing a ling hydrogen;

$R_{71}$ is substituted or unsubstituted alkyl;

Z is located at any ring position not adjacent to the ketocarbonyl group and is a group having one of the formulae:

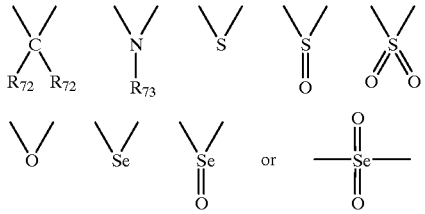

wherein each $R_{72}$ is individually a substituted or unsubstituted alkyl, aryl or heterocyclic group, or a carbamoyl carbonamido, sulfamoyl, sulfonamido, ester or acid group;

$R_{73}$ is

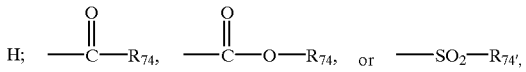

substituted or unsubstituted alkyl or aryl or a photographic ballast group;

$R_{74}$ is substituted or unsubstituted alkyl or aryl;

$R_{74'}$ is substituted or unsubstituted alkyl or aryl, or —N($R_{75}$)($R_{76}$) where $R_{75}$ and $R_{76}$ individually are hydrogen, or substituted or unsubstituted alkyl or aryl.

* * * * *